US011446713B2

(12) United States Patent
Iwamoto et al.

(10) Patent No.: US 11,446,713 B2
(45) Date of Patent: Sep. 20, 2022

(54) GAS PURGE UNIT AND LOAD PORT APPARATUS

(71) Applicant: TDK CORPORATION, Tokyo (JP)

(72) Inventors: Tadamasa Iwamoto, Tokyo (JP); Jun Emoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 745 days.

(21) Appl. No.: 16/198,231

(22) Filed: Nov. 21, 2018

(65) Prior Publication Data

US 2019/0168268 A1 Jun. 6, 2019

Related U.S. Application Data

(63) Continuation-in-part of application No. 14/946,521, filed on Nov. 19, 2015, now Pat. No. 10,512,948.

(30) Foreign Application Priority Data

Nov. 21, 2014 (JP) ..... 2014-236227

(51) Int. Cl.
*B08B 5/02* (2006.01)

(52) U.S. Cl.
CPC ..... *B08B 5/02* (2013.01)

(58) Field of Classification Search
CPC .... B08B 5/02; B08B 7/02; B08B 5/00; B08B 9/08; B08B 9/0813; B05B 1/005; B05B 1/14; B05B 1/28; B05B 1/34; H01L 21/67034; H01L 21/67028; H01L 21/37389
USPC ..... 15/316.1, 406, 405, 301
See application file for complete search history.

(56) References Cited

U.S. PATENT DOCUMENTS

2009/0169342 A1* 7/2009 Yoshimura ..... H01L 21/67775 414/217
2013/0042945 A1* 2/2013 Emoto ..... H01L 21/67017 141/98
2015/0040950 A1 2/2015 Kaise et al.
2016/0118279 A1 4/2016 Iyer et al.

FOREIGN PATENT DOCUMENTS

JP 2008-135791 A 6/2008
JP 2013-161924 A 8/2013
JP 2017-228678 A 12/2017
WO WO 2005/124853 A1 12/2005
WO WO 2016/065200 4/2016
WO WO-2016065200 A1 * 4/2016 ..... H01L 21/67772

* cited by examiner

*Primary Examiner* — Monica S Carter
*Assistant Examiner* — Abbie E Quann
(74) *Attorney, Agent, or Firm* — ArentFox Schiff LLP

(57) ABSTRACT

A gas purge unit introduces a cleaning gas into a purge container with an opening therethrough. The gas purge unit includes a first blowout member second blowout member. The first blowout member is disposed along a lateral the opening and includes a first nozzle port. The first nozzle port blows the cleaning gas into the purge container. The second blowout member is disposed along the lateral side and includes a second nozzle port. The second nozzle port is disposed farther from the opening than the first nozzle port and blows the cleaning gas into the purge container. A load port apparatus includes the gas purge unit.

15 Claims, 30 Drawing Sheets

GAS PURGE UNIT AND LOAD PORT APPARATUS

CROSS-REFERENCE TO RELATED APPLICATIONS

This application is a Continuation-in-part of U.S. patent application Ser. No. 14/946,521, filed on Nov. 19, 2015, which claims priority to Japanese Patent Application No. 2014-236227, filed Nov. 21, 2014. The entire contents of the priority applications are incorporated herein by reference.

BACKGROUND OF THE INVENTION

1. Field of the Invention

The present invention relates to a gas purge unit and a load port apparatus used for a manufacturing process of semiconductors, for example.

2. Description of the Related Art

In the manufacturing process of semiconductors, wafers housed in a wafer transport container include ones on which metal wirings or so are formed, for example. It may become impossible to obtain desired characteristics at the time of completion of elements due to oxidation of the surface of the metal wirings. Thus, the cleanliness inside the container is necessary to be kept high.

However, when wafers in a pod are brought to various processing apparatuses for performing a predetermined processing thereto, the inside of the container and the inside of the processing apparatuses are constantly kept in a connected state. A fan and a filter are arranged at an upper area of a room where a transport robot is disposed, and a cleaning air with controlled particles is normally introduced into the room. When this air enters the container, however, the wafers may have an oxidized surface due to oxygen or water in the air.

For example, Patent Document 1 discloses that a purge gas, such as nitrogen gas, is introduced into a container, and that a gas blows out along an opening surface of an opening to prevent an introduction of a dirty air from the inside of a processing room into the container.

In conventional apparatuses, however, a container-inward nozzle that blows a gas into a container is disposed at a lateral side of an opening, and a curtain nozzle that blows a gas along an opening surface of the opening is disposed at an upper side of the opening. The gas flow from the curtain nozzle is weak at a lower part of the opening surface, and a sufficient shielding effect (curtain effect) may not be obtained.

Thus, there is a problem that arrival rates for purge completion vary between upper and lower parts of the container. There is also a problem that gas exchange cannot ideally be performed due to complexity of channels of purge gas in the container. In such a case, for example, there is further a problem that oxygen or water concentration in the atmosphere varies between wafers placed at the lower part of the container and wafers placed at the upper part of the container, and that the wafers are thus processed unevenly in the subsequent manufacturing processes.

Patent Document 1: WO2005/124853 A1

SUMMARY OF THE INVENTION

The present invention has been achieved under such circumstances. It is an object of the invention to provide a gas purge unit capable of uniformly performing gas exchange particularly in the vertical direction in a purging container and to provide a load port apparatus including the gas purge unit.

To achieve the above object, a gas purge unit according to a first aspect of the present invention introduces a cleaning gas into a purge container with an opening therethrough and includes:

a first nozzle outlet configured to blow the cleaning gas from a lateral side of the opening into the purging container; and a second nozzle outlet configured to blow the cleaning gas from the lateral side of the opening along an opening surface of the opening.

In the gas purge unit according to the first aspect of the present invention, the second nozzle outlet configured to blow the cleaning gas along the opening surface of the opening is disposed along the lateral side of the opening. Thus, the gas flow from the second nozzle outlet produces a curtain flow that blocks an airflow from the outside to the inside of the container through the opening. This curtain flow is generated from the lateral side of the opening of the container and is thereby vertically uniform in the container. The first nozzle outlet configured to blow the cleaning gas into the container is disposed along the lateral side of the opening, and an airflow going into the container is vertically uniform in the container.

In the first aspect of the present invention, a uniform gas exchange can be achieved particularly in the vertical direction. As a result, it is possible to obtain a uniform quality of objects to be processed, such as wafers housed in the container. Incidentally, a part of the gas blown from the second nozzle outlet enters the container.

Preferably, the first nozzle outlet and the second nozzle outlet are formed on a single bidirectional blowout member. This reduces the number of parts and contributes to downsizing of the unit.

The bidirectional blowout member is disposed at least at one of lateral sides of the opening, but the bidirectional blowout members are preferably arranged to face each other at both lateral sides of the opening. This structure generates curtain flows from both lateral sides and increases an effect of blocking an airflow trying to enter the container from the outside of the container via the opening. Also, the cleaning gas directed into the container is blown from two points (both lateral sides of the opening), and the gas in the container is thereby exchanged quickly and uniformly.

The first nozzle outlet may be formed on a first-dedicated blowout member, and the first-dedicated blowout member may be disposed at least at one of the lateral sides of the opening. Also, the second nozzle outlet may be formed on a second-dedicated blowout member, and the second-dedicated blowout member may be disposed at least at one of the lateral sides of the opening.

Preferably, the first-dedicated blowout member is disposed closer to the opening than the second-dedicated blowout member. In this arrangement, a curtain flow from the second nozzle outlet of the second-dedicated blowout member is prevented from interfering with a container-inward flow from the first nozzle outlet of the first-dedicated blowout member, and both flows become smooth.

Preferably, the first nozzle outlet and the second nozzle outlet are continuously or intermittently formed along the longitudinal direction of the lateral sides of the opening. The first nozzle outlet and the second nozzle outlet may be a narrow and long blowout outlet like a slit or may be a combination of multiple blowout holes. The nozzle outlets may be a slit-like through hole formed along the longitudinal direction of a tube member, a circular through hole, or a through hole formed inside a nozzle protruding from a tube member.

In a gas purge device according to a first aspect of the present invention, the purging container is detachably attached from the outside to a wall-side opening formed on a wall sealed internally, the opening of the purging container and the wall-side opening are configured to be connected airtightly, and any of the above-mentioned gas purge units is attached to at least one of the lateral sides of the wall-side opening in the wall.

A gas purge unit according to a second aspect of the present invention introduces a cleaning gas into a purge container with an opening therethrough and includes:

a first nozzle port configured to blow the cleaning gas from a lateral side of the opening into the purge container; and a second nozzle port disposed farther from the opening than the first nozzle port and configured to blow the cleaning gas into the purge container.

In the gas purge unit according to the second aspect of the present invention, the first nozzle port and the second nozzle port are arranged along the lateral side of the opening. Thus, a gas flow from the first nozzle port and the second nozzle port is generated from the lateral side of the opening of the container and is thereby vertically uniform in the container.

In the second aspect of the present invention, a uniform gas exchange can hence be achieved, particularly in the vertical direction, in the container 2. As a result, it is possible to obtain a uniform quality of objects to be processed, such as wafers housed in the container. Incidentally, a part of a gas flow from the second nozzle port into the container functions similarly to a curtain flow of the gas purge unit according to the first aspect and can block an airflow trying to enter the container from the outside of the container via the opening.

In the second aspect of the present invention, the first second nozzle ports configured to blow a cleaning gas into the purge container are arranged in parallel along the lateral side of the opening, and the inside of the container can thereby efficiently be cleaned. That is, the first and second nozzle ports with different distances from the opening are arranged in parallel, and layers of cleaning gases going into the container are thereby thicker compared to only the first nozzle port. Thus, a gas having a low cleanliness in the chamber is not dragged into the container. The second nozzle port also discharges a cleaning gas into the purge container, and a great amount of cleaning gases can thereby be introduced into the purge container and discharged from the opening to the outside, compared to only the first nozzle port.

Preferably, the first nozzle port and the second nozzle port are formed on a single bidirectional blowout member. This reduces the number of parts and contributes to downsizing of the unit.

The bidirectional blowout member is disposed at least at one of lateral sides of the opening, but the bidirectional blowout members are preferably arranged to face each other at both lateral sides of the opening. This structure generates gases from both lateral sides and increases an effect of blocking an airflow trying to enter the container from the outside of the container via the opening. Also, the cleaning gas directed into the container is blown from two points (both lateral sides of the opening), and the gas in the container is thereby exchanged quickly and uniformly.

The first nozzle outlet may be formed on a first-dedicated blowout member, and the first-dedicated blowout member may be disposed at least at one of the lateral sides of the opening (preferably, both lateral sides). Also, the second nozzle outlet may be formed on a second-dedicated blowout member, and the second-dedicated blowout member may be disposed at least at one of the lateral sides of the opening (preferably, both lateral sides).

Preferably, the first-dedicated blowout member is disposed closer to the opening than the second-dedicated blowout member. In this arrangement, a gas flow from the second nozzle outlet of the second-dedicated blowout member is prevented from interfering with a container-inward flow from the first nozzle outlet of the first-dedicated blowout member, and both flows become smooth.

Preferably, the first nozzle outlet and the second nozzle outlet are continuously or intermittently formed along the longitudinal direction of the lateral sides of the opening. The first nozzle outlet and the second nozzle outlet may be a narrow and long blowout outlet like a slit or may be a combination of multiple blowout holes. The nozzle outlets may be a slit-like through hole formed along the longitudinal direction of a tube member, a circular through hole, or a through hole formed inside a nozzle protruding from a tube member.

In a gas purge device according to a second aspect of the present invention, the purging container is detachably attached from the outside to a wall-side opening formed on a wall sealed internally, the opening of the purging container and the wall-side opening are configured to be connected airtightly, and any of the above-mentioned gas purge units is attached to at least one of the lateral sides of the wall-side opening in the wall.

A gas purge unit according to a third aspect of the present invention introduces a cleaning gas into a purge container with an opening therethrough and includes:

a first blowout member disposed along a lateral side of the opening and including a first nozzle port configured to blow the cleaning gas into the purge container; and a second blowout member disposed along the lateral side and including a second nozzle port disposed farther from the opening than the first nozzle port and configured to blow the cleaning gas into the purge container.

In the third aspect of the present invention, the first and second nozzle ports configured to blow a cleaning gas into the purge container are arranged in parallel along the lateral side of the opening, and the inside of the container can thereby efficiently be cleaned. That is, since the first and second nozzle ports with different distances from the opening are arranged in parallel, layers of cleaning gases going into the container are thicker compared to only the first nozzle port, and a great amount of gases flows from the opening of the container to the outside. Thus, a gas having a low cleanliness in the chamber can effectively be prevented from being dragged into the container. The second nozzle port also discharges a cleaning gas into the purge container, and a great amount of cleaning gases can thereby be introduced into the purge container and discharged from the opening to the outside, compared to only the first nozzle port.

For example, the gas purge unit according to the third aspect of the present invention may include a third blowout member disposed along an upper side of the opening and including a third nozzle port configured to blow the cleaning gas along an opening surface of the opening.

When the gas purge unit according to the third aspect of the present invention further include the third blowout member configured to blow a cleaning gas along the opening surface, an airflow having a low cleanliness in the chamber can effectively be prevented from being caught in an airflow of a cleaning gas going into the container, and an efficient cleaning can be achieved. The third blowout member discharges a cleaning gas downward from the upper side along the opening surface, and cleaning gases from the first and second blowout members can effectively be prevented from being disturbed by an airflow going downward in the chamber, such as a downflow by FFU.

For example, the first blowout member may include a first channel for the cleaning gas connected to the first nozzle port. The third blowout member may include a third channel for the cleaning gas connected to the third nozzle port. The first blowout member and the third blowout member may be connected so that the first channel and the third channel are communicated.

When the first blowout member and the third blowout member are connected so that the first channel and the third channel are communicated, the gas purge unit according to the third aspect of the present invention can reduce a total length of paths of cleaning gases and simplify the structure of paths of cleaning gases.

For example, the second blowout member may include a second channel for the cleaning gas connected to the second nozzle port. The third blowout member may include a third channel for the cleaning gas connected to the third nozzle port. The second blowout member and the third blowout member may be connected so that the second channel and the third channel are communicated.

When the second blowout member and the third blowout member are connected so that the second channel and the third channel are communicated, the gas purge unit according to the third aspect of the present invention can reduce a total length of paths of cleaning gases and simplify the structure of paths of cleaning gases. Moreover, when the second channel and the third channel are communicated, the supply of cleaning gases that prevent dragging of an airflow having a low cleanliness in the chamber can be controlled altogether.

For example, the gas purge unit according to the third aspect of the present invention may include a cover member disposed with a predetermined distance to the first blowout member and the second blowout member and surrounding the first blowout member and the second blowout member at least from the other side of blowout directions of the first nozzle port and the second nozzle port. The gas purge unit according to the third aspect of the present invention may include an eave member disposed along an upper side of the opening and protruding in a normal direction of an opening surface of the opening. The cover member and the eave member may be integrally connected to each other.

The cover member and the eave member can prevent an airflow of cleaning gases of the first and second nozzle ports from being disturbed by an airflow formed in the chamber by a downflow of FFU. The gas purge unit according to the third aspect of the present invention can thereby efficiently clean the container.

When the cover member and the eave member are integrally connected to each other, an airflow of cleaning gases from the first and second nozzle ports can effectively be prevented from being disturbed, and the protection structure of the airflow of the cleaning gases can be simplified.

A load port apparatus according to the present invention includes any of the above-mentioned gas purge units. The load port apparatus according to the present invention including any of the above-mentioned gas purge units can efficiently clean the inside of the container installed on the load port apparatus and effectively prevent oxidation of wafers.

DESCRIPTION OF THE PREFERRED EMBODIMENTS

Hereinafter, the present invention is described with reference to embodiments shown in the figures.

First Embodiment

Figure 1A:
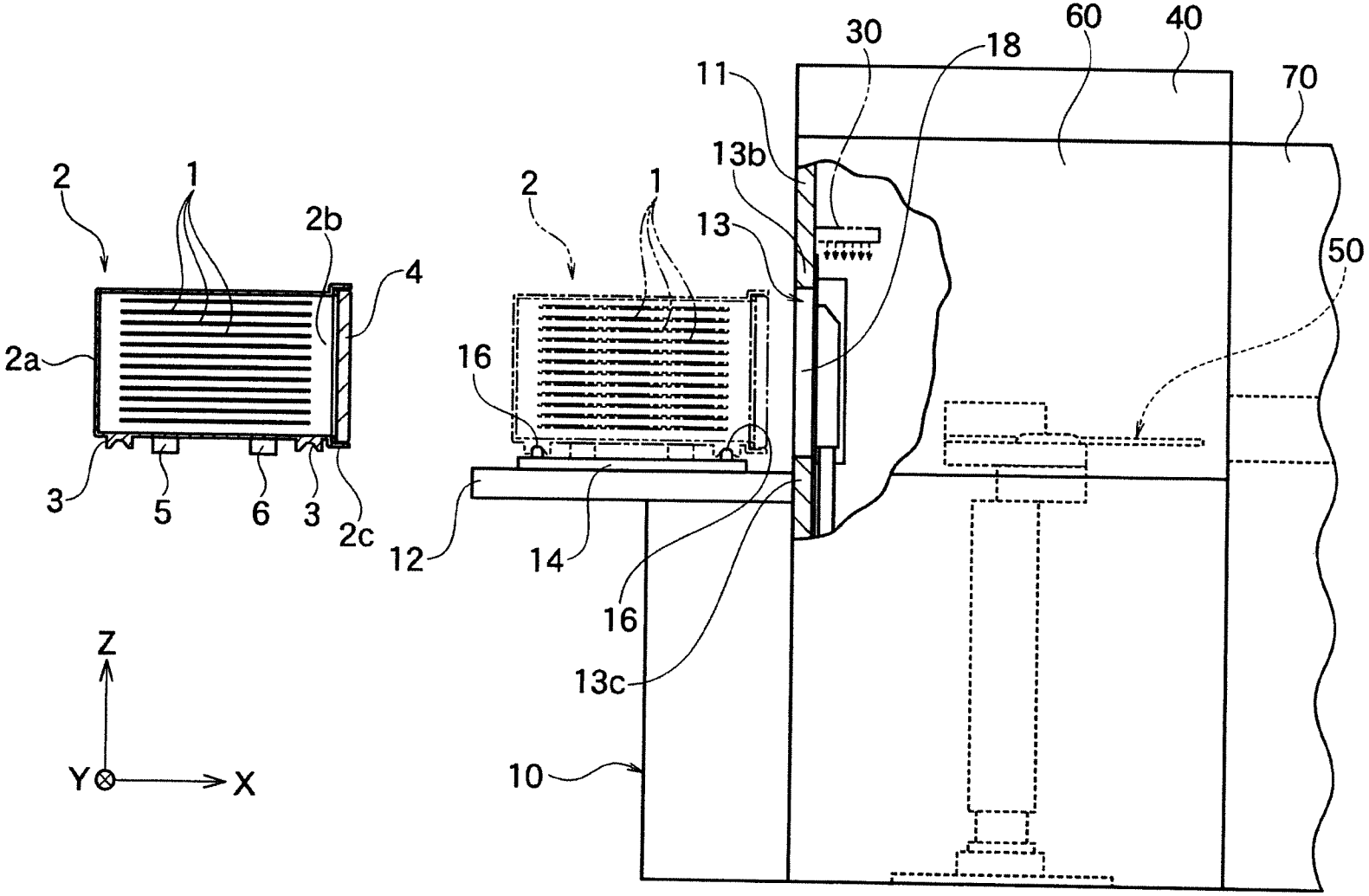
FIG. 1A is a partial cross-sectional schematic view of a load port apparatus to which a gas purge unit according to an embodiment of the present invention is applied.

As shown in FIG. 1A, a load port apparatus 10 according to an embodiment of the present invention is connected to an intermediate chamber 60 such as an equipment front end module (EFEM). The load port apparatus 10 includes an installation stand 12 and a movable table 14. The movable table 14 is movable on the installation stand 12 in the X-axis direction. In the figures, the X-axis represents a movement direction of the movable table 14, the Z-axis represents the vertical direction, and the Y-axis represents a perpendicular direction to the X-axis and the Z-axis.

A sealed transport container 2 can detachably be placed on the top of the movable table 14 in the Z-axis direction. The sealed transport container 2 consists of a pot, a FOUP, etc. for transporting a plurality of wafers 1 while they are sealed and stored, and has a casing 2*a*. A space for housing the wafers 1 (objects to be processed) is formed inside the casing 2*a*. The casing 2*a* has an approximately box-like shape with an opening on one of its surfaces present in the horizontal direction.

The sealed transport container 2 also includes a lid 4 for sealing an opening 2*b* of the casing 2*a*. Shelves (not shown) with multiple stages for horizontally holding the wafers 1 to be overlapped vertically (Z-axis direction) are arranged inside the casing 2*a*. The wafers 1 placed on the shelves are respectively housed inside the container 2 at regular intervals.

The load port apparatus 10 is an interface device for transporting wafers housed in a sealed state in the sealed transport container 2 into the intermediate chamber 60 while a clean state is being maintained. One or plural processing chambers 70 are connected airtightly in the intermediate chamber 60. The processing chamber 70 is not limited and is used, for example, for a vapor apparatus, a sputtering apparatus, an etching apparatus, and the like during semiconductor manufacturing process.

The intermediate chamber 60 houses a robot arm 50. A fan filter unit (FFU) 40 is mounted on the top of the intermediate chamber 60, and a clean air flows by downflow from the FFU 40 into the intermediate chamber 60, and a local clean environment is produced. The inside of the intermediate chamber 60 is not cleaner than the inside of the sealed transport container 2 mentioned below, but is cleaner than the external environment.

The load port apparatus 10 includes a door 18 for opening and closing a wall-side opening 13 of a wall 11. The wall 11 functions as a part of a casing for sealing the intermediate chamber 60 in a clean state. FIG. 3A to FIG. 3D briefly explain how the door 18 moves.

Figure 3A:
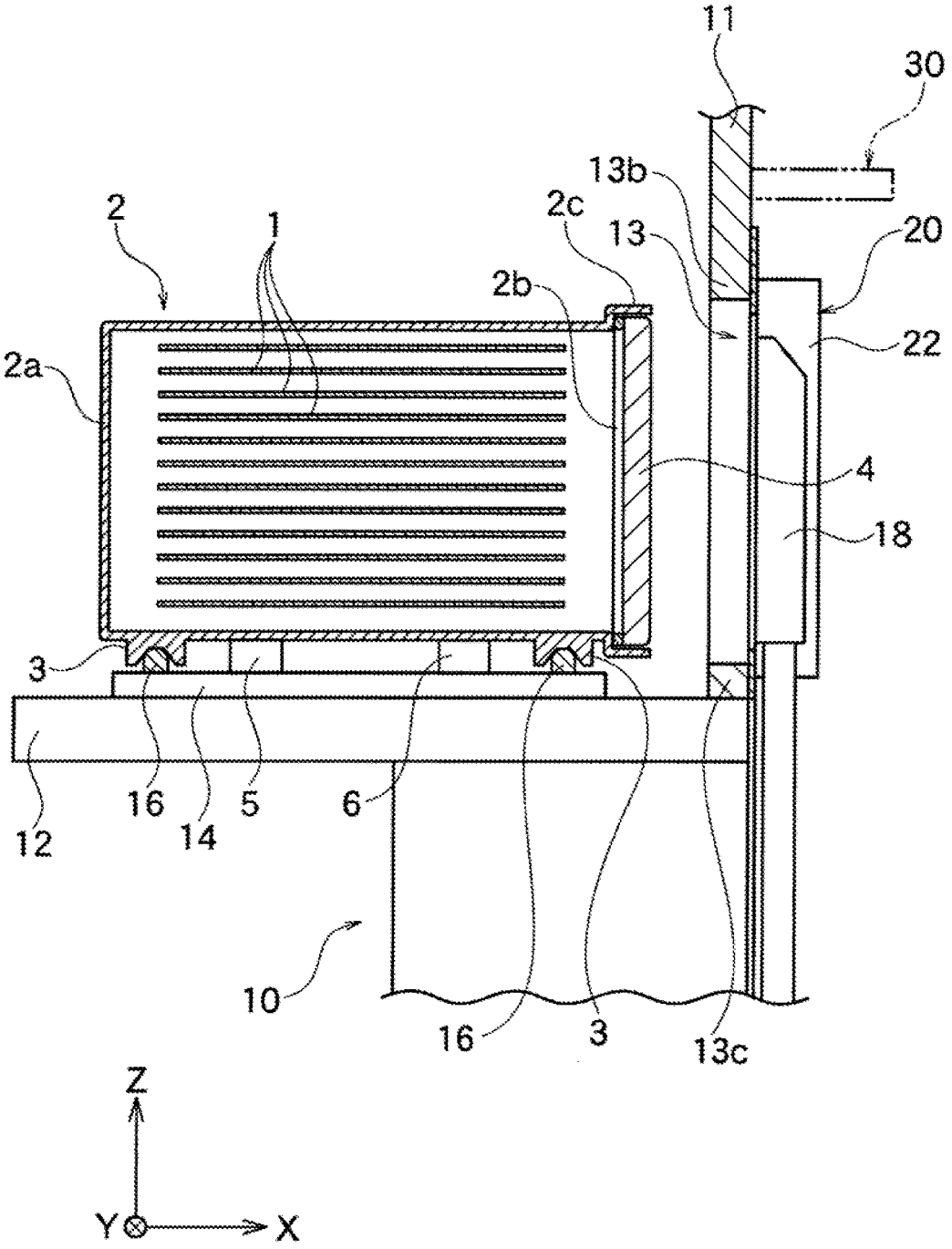
FIG. 3A is a schematic view showing a step where a lid of a FOUP is opened by a load port apparatus.

As shown in FIG. 3A, when the container 2 is mounted on the table 14, positioning pins 16 are engaged with concaves of positioning portions 3 arranged on a bottom surface of the casing 2*a* of the container 2, and then a positional relation between the container 2 and the movable table 14 is determined nonambiguously. During storage or transportation of the wafers 1, the sealed transport container 2 is internally sealed, and the surroundings of the wafers 1 are maintained in a clean environment.

Figure 3B:
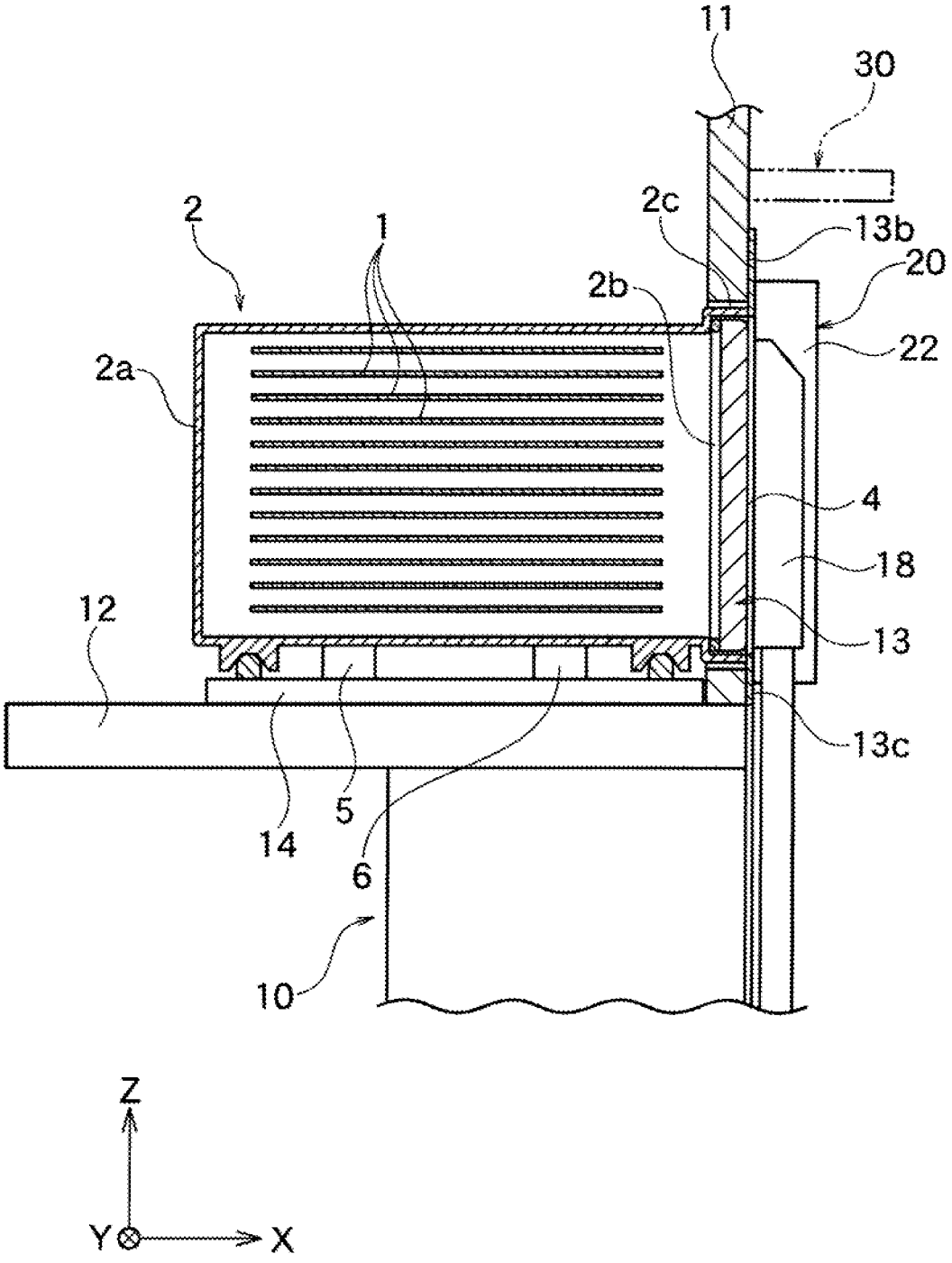
FIG. 3B is a schematic view showing the next step of FIG. 3A.

When the sealed transport container 2 is positioned to be placed on the top surface of the movable table 14, an intake port 5 and an exhaust port 6 formed on the bottom surface of the sealed transport container 2 are respectively airtightly connected to a bottom purge apparatus placed inside the table 14. Then, a bottom gas purge is performed via the intake port 5 and the exhaust port 6 arranged on the bottom of the container 2. As shown in FIG. 3B, when the bottom gas purge is being performed, the table 14 moves in the X-axis direction, and opening edges 2*c* attached with the lid 4 airtightly sealing the opening 2*b* of the container 2 enter the wall-side opening 13 of the wall 11.

Figure 3C:
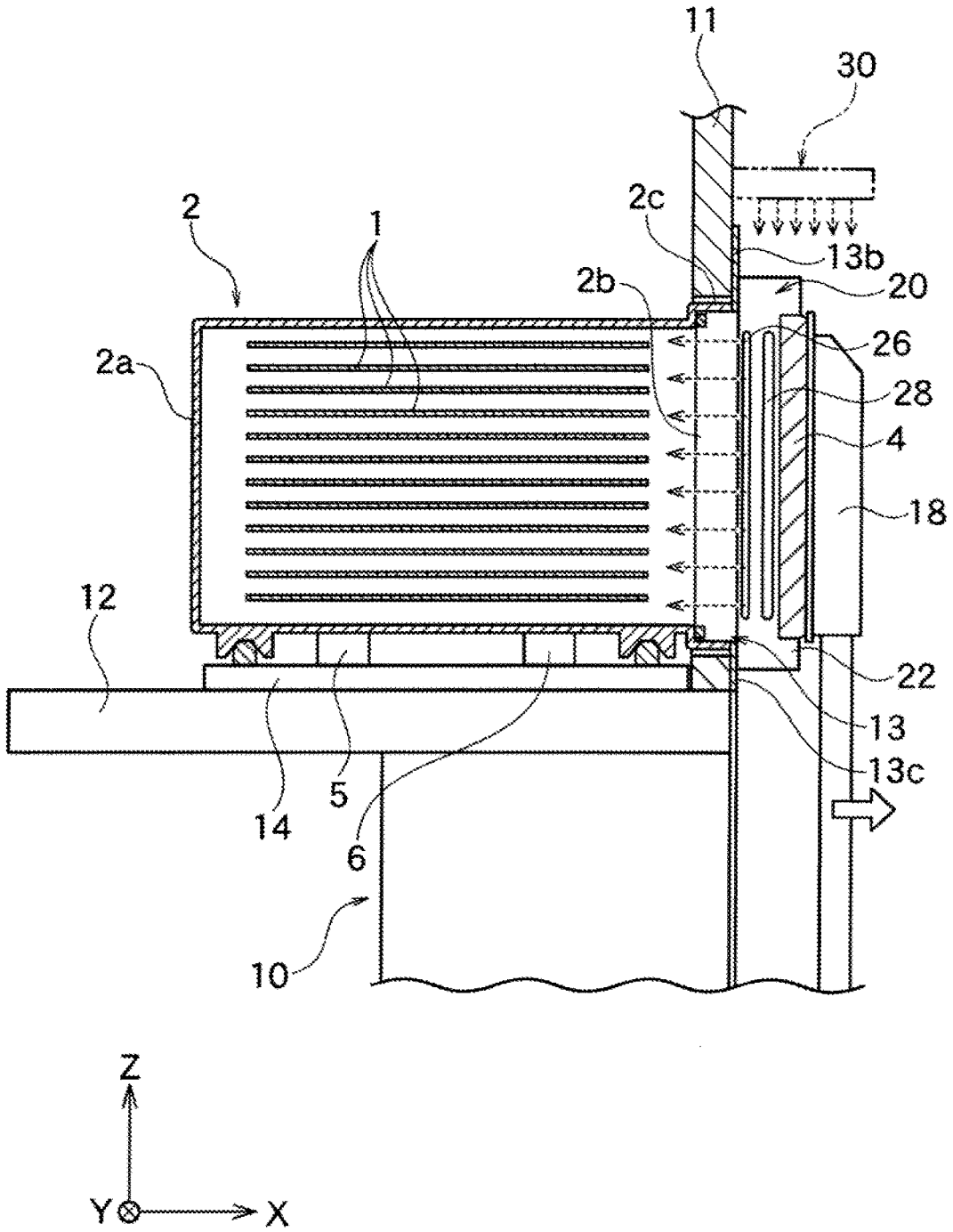
FIG. 3C is a schematic view showing the next step of FIG. 3B.

At the same time, the door 18 located inside the wall 11 (opposite to the table 14) is engaged with the lid 4 of the container 2. At that time, a space between the opening edges 2*c* and opening edges of the wall-side opening 13 is sealed by a gasket or so in a good state. Thereafter, as shown in FIG. 3C, the container 2 and the wall 11 are internally connected by moving the door 18 together with the lid 4 in parallel along the X-axis direction or moving them rotationally, detaching the lid 4 from the opening edges 2*c*, opening the opening 2*b*, and connecting the opening 2*b* and the wall-side opening 13.

At that time, the bottom gas purge may continuously be operated. In addition to the bottom purge or after stopping the bottom purge, purge gas (cleaning gas) such as nitrogen gas or any other inert gas is blown from the inside of the wall 11 into the container 2 (front purge).

Figure 3D:
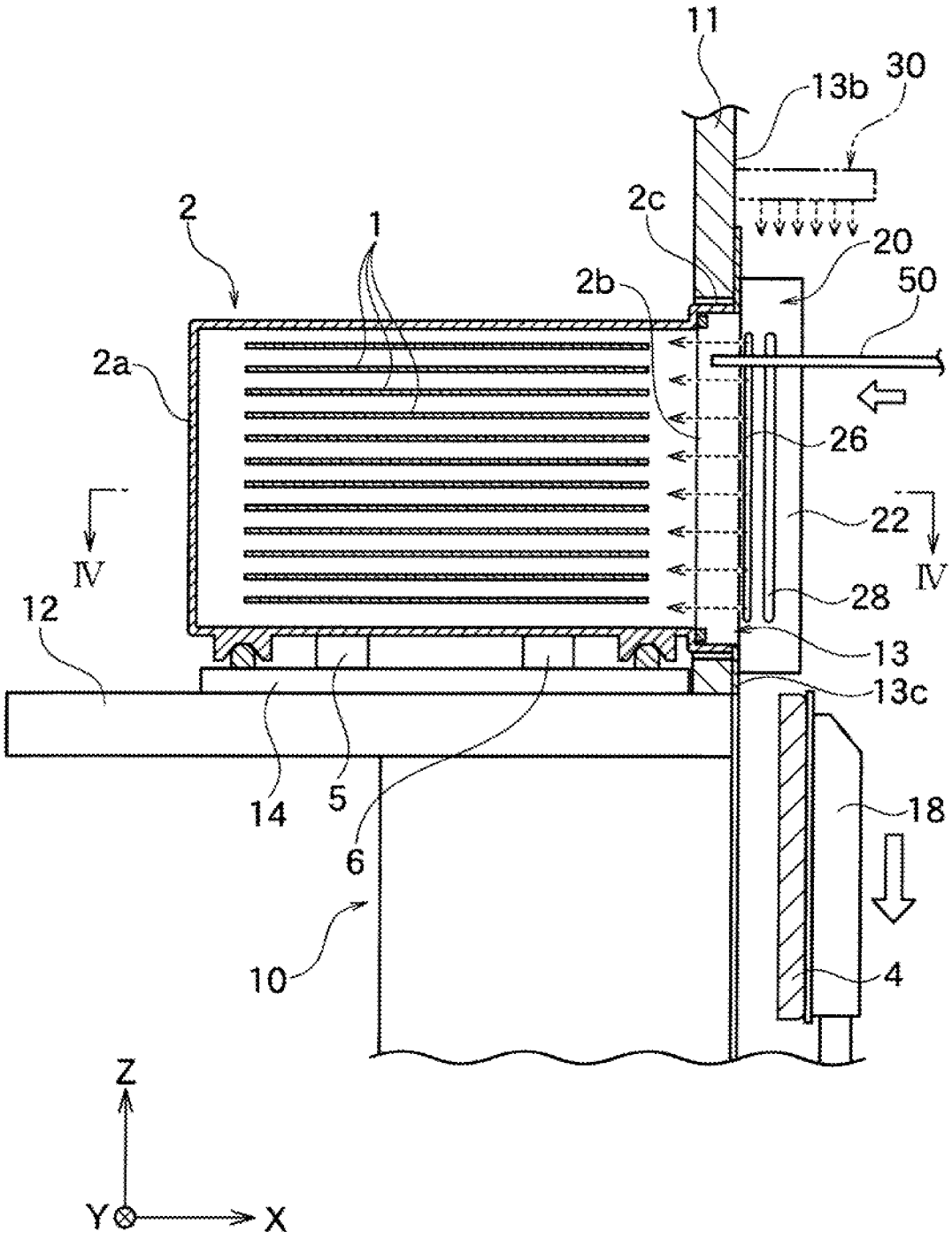
FIG. 3D is a schematic view showing the next step of FIG. 3C.

Next, as shown in FIG. 3D, when the door 18 is moved downward in the Z-axis in the wall 11, the opening 2*b* of the container 2 is completely opened against the inside of the wall 11, and the wafers 1 are delivered into the wall 11 via the opening 2*b* and the wall-side opening 13 by a robot hand 50 disposed in the wall 11. At that time, the container 2 and the wall 11 are internally cut off from outside air, and at least the front purge is continuously operated to maintain a clean environment within the container 2. An operation opposite to the above is carried out to return the wafers 1 to the inside of the container 2 and detach it from the table 14.

Note that, the intake port 5, the exhaust port 6, the gas purge units 20, and the like are enlarged in the figures for easy understanding compared with the sealed transport container 2, but are different from actual dimension ratio.

Next, the gas purge unit 20 for performing front purge according to the present embodiment is described with reference to the figures.

Figure 1B:
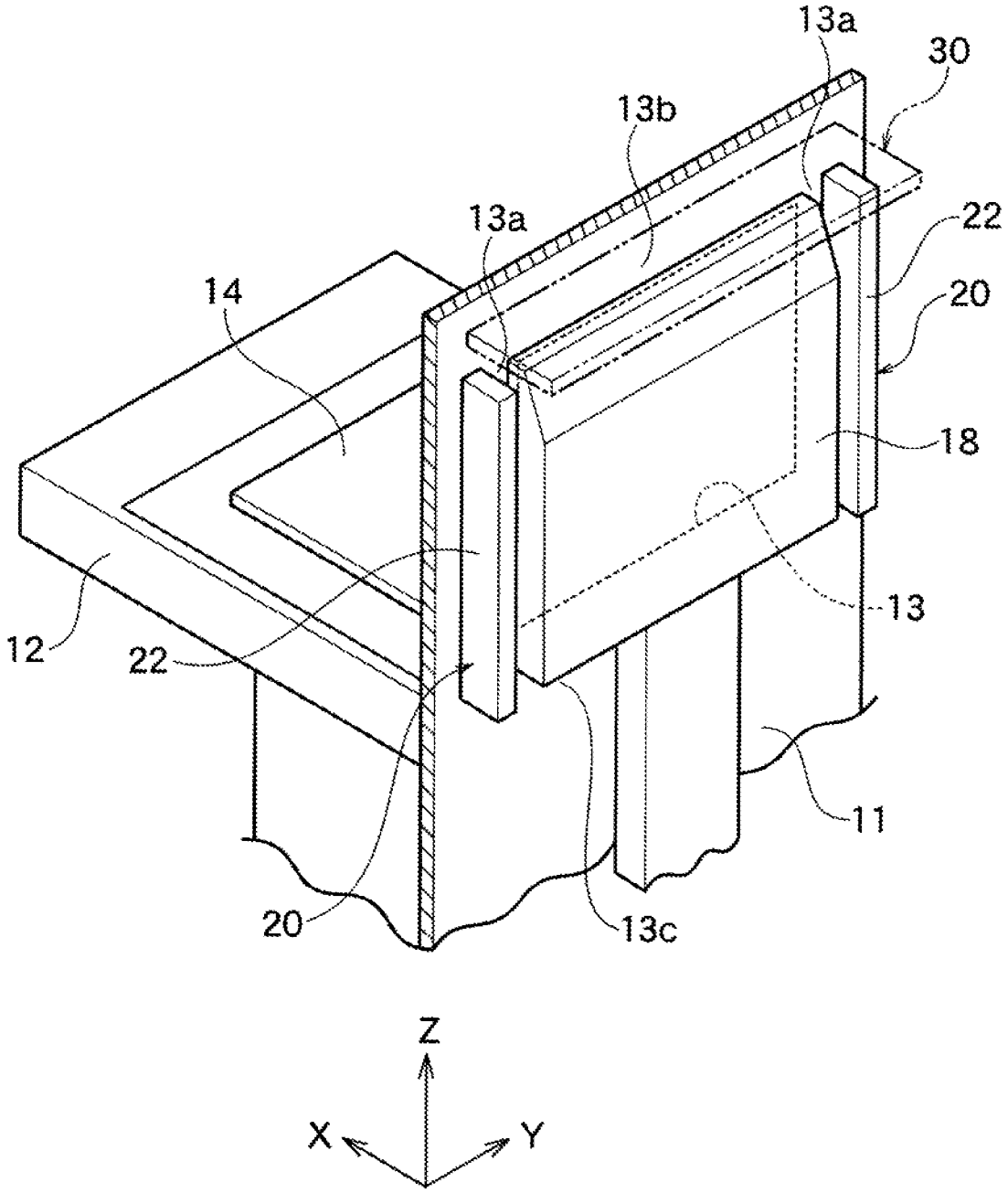
FIG. 1B is a partial cross-sectional perspective view of the load port apparatus shown in FIG. 1A.
Figure 4A:
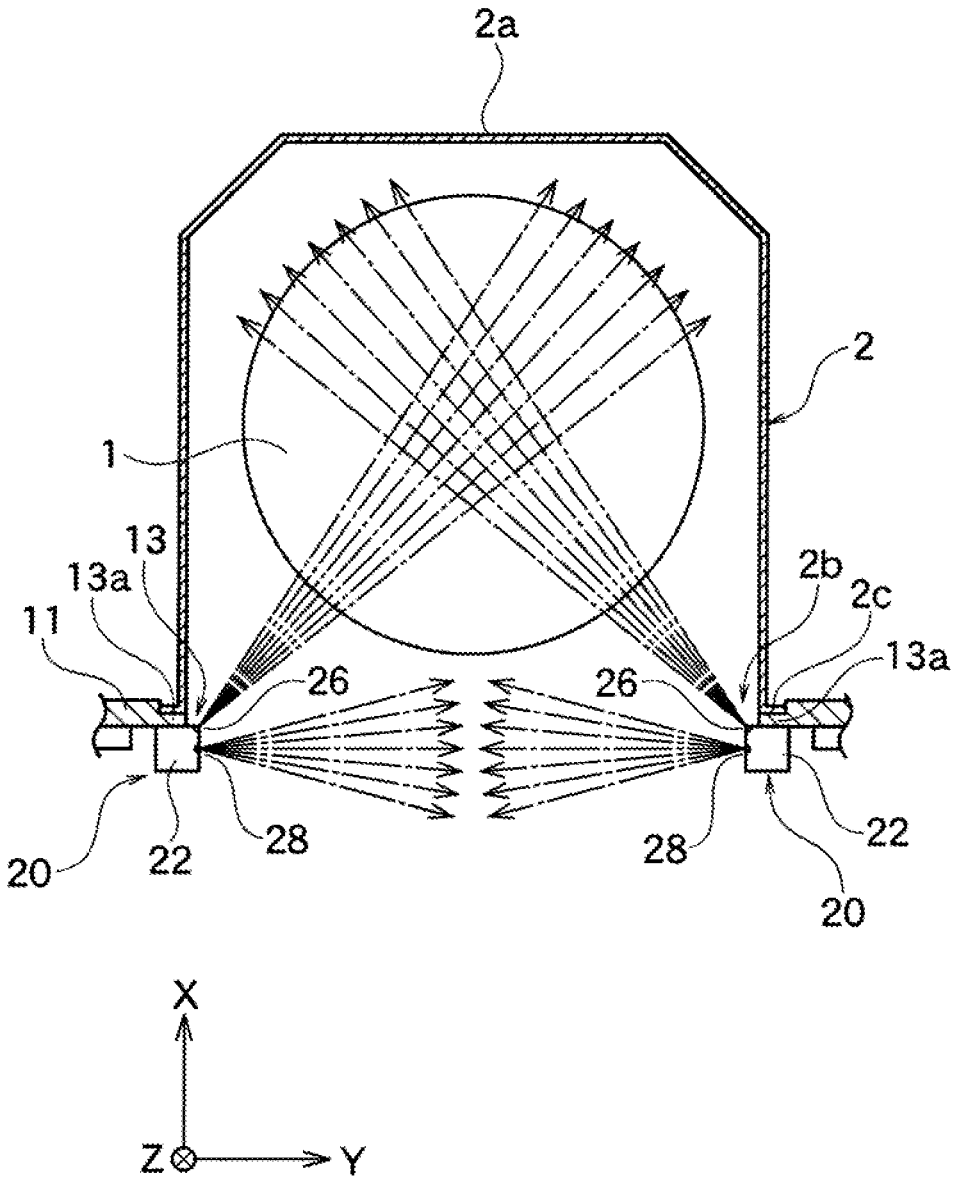
FIG. 4A is a cross-sectional view in a container taken along line IV-IV shown in FIG. 3D.

As shown in FIG. 1B, in this embodiment, the wall-side opening 13 formed on the wall 11 has a rectangular opening surface and is enclosed by an upper side 13*b*, a lower side 13*c*, and two lateral sides 13*a*. As shown in FIG. 4A, the opening 2*b* of the container 2 has a shape corresponding to the wall-side opening 13 and is configured to have the same or a little smaller size than the wall-side opening 13.

As shown in FIG. 1B, in this embodiment, the gas purge units 20 are respectively attached at both of the lateral sides 13*a* of the wall-side opening 13 on an inner surface of the wall 11 to avoid touching the door 18. The inner surface of the wall 11 is a surface of the wall 11 opposite to the installation stand 12.

As shown in FIG. 3D and FIG. 4A, each of the gas purge units 20 is placed at both of the lateral sides 13*a* of the wall-side opening 13 so as to be longer than the opening 2*b* of the container 2 in the Z-axis direction. Each of the gas purge units 20 has the bidirectional blowout member 22.

Figure 1C:
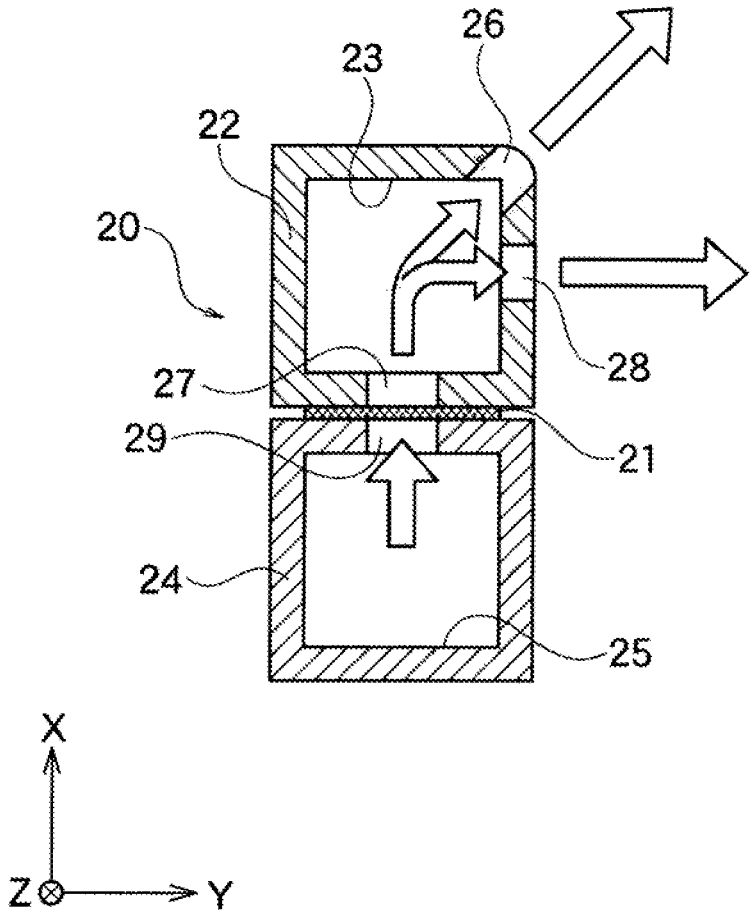
FIG. 1C is a cross-sectional view of the gas purge unit shown in FIG. 1B.

In this embodiment, the bidirectional blowout member 22 is made of a tube member that is narrow and long in the Z-axis direction and includes a blowout channel 23 with square cross sectional shape and a first nozzle outlet 26 at a corner thereof, as shown in FIG. 1C. Also, a second nozzle outlet 28 is formed on a plane part of the square-tube bidirectional blowout member 22 so as to be adjacent to the first nozzle outlet 26.

Figures 2A, 2B, 2C, 2D:
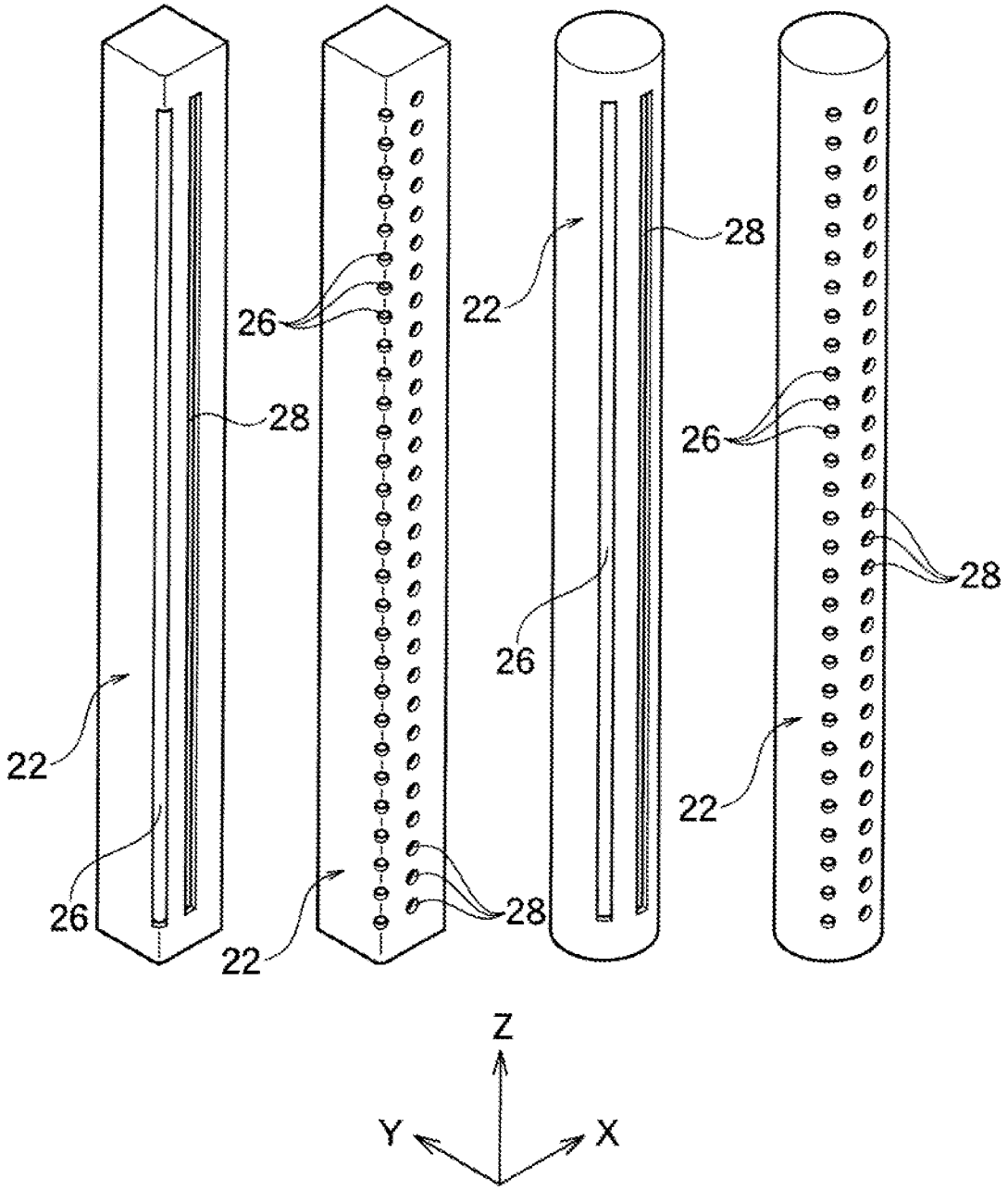
FIG. 2A is a perspective view of a bidirectional blowout member of the gas purge unit shown in FIG. 1C.
FIG. 2B is a perspective view showing a variation of the bidirectional blowout member shown in FIG. 2A.
FIG. 2C is a perspective view showing another variation of the bidirectional blowout member shown in FIG. 2A.
FIG. 2D is a perspective view showing further another variation of the bidirectional blowout member shown in FIG. 2A.

In this embodiment, as shown in FIG. 2A, the first nozzle outlet 26 and the second nozzle outlet 28 are respectively made of a slit-like through hole continuously formed in the Z-axis direction of the square-tube bidirectional blowout member 22, and are parallel to each other with a predetermined distance in the X-axis direction.

As shown in FIG. 1C, an intake member 24 may be connected to the bidirectional blowout member 22, although not necessarily needed. In this embodiment, as is the case with the bidirectional blowout member 22, the intake member 24 is made of a tube member that is narrow and long in the Z-axis direction and includes a blowout channel 25 with square cross sectional shape. A connecting hole 27 formed on the bidirectional blowout member 22 and a connecting hole 29 formed on the intake member 24 are connected by a filter 21.

For example, each of the connecting holes 27 and 29 is made of a slit-like through hole continuously formed in the Z-axis direction or an intermittently formed through hole. A cleaning gas circulating through the intake channel 25 of the intake member 24 goes into the blowout channel 23 of the bidirectional blowout member 22 via the connecting holes 27 and 29 and the filter 21 and is blown from the first nozzle outlet 26 and the second nozzle outlet 28 to the outside.

The intake member 24 allows a more uniform flow speed of the cleaning gases in the Z-axis direction blown from the first nozzle outlet 26 and the second nozzle outlet 28 to the outside. Alternatively, the intake member 24 also allows an intentionally controlled flow speed of the cleaning gases in the Z-axis direction blown from the first nozzle outlet 26 and the second nozzle outlet 28 to the outside.

A gas supply to the bidirectional blowout member 22 via the intake member 24 or a direct gas supply to the bidirectional blowout member 22 is not illustrated in the figures, but may be performed together with the gas purge units 20 from above or below in the Z-axis direction, for example. Also, a gas supply may be performed from below in one of the gas purge units 20, and a gas supply may be performed from above in the other gas purge unit 20.

Note that, the first nozzle outlet 26 and the second nozzle outlet 28 are made of a slit-like narrow and long blowout hole in this embodiment, but may be a combination of multiple blowout holes. Also, these nozzle outlets 26 and 28 may be slit-like through holes formed along the longitudinal direction of a tube member, circular through holes, or through holes formed inside nozzles protruding from a tube member. Further, the first nozzle outlet 26 and the second nozzle outlet 28 are not necessarily made of the same type of through holes. For example, the first nozzle outlet 26 may be made of a slit-like through hole and the second nozzle outlet 28 may be made of a combination of a plurality of blowout holes, or the contrary is possible. In this embodiment, as shown in FIG. 2C and FIG. 2D, the bidirectional blowout member 22 may have a cylindrical shape or any other tubular shape.

In the present embodiment, as shown in FIG. 4A, a pair of bidirectional blowout members 22 is oppositely attached on the inner surface of the wall 11 at both of the lateral sides 13*a* of the wall-side opening 13. That is, gases from the first nozzle outlets 26 are directed into the container 2, and gases from the second nozzle outlets 28 are directed along the opening surface of the openings 13 and 2*b*.

In the present embodiment, the gases from the second nozzle outlets 28 formed on the respective bidirectional blowout members 22 oppositely flow to cover the opening surfaces of the openings 13 and 2*b*, and a curtail flow is produced. Also, the gases from the first nozzle outlets 26 formed on the respective bidirectional blowout members 22 flow into the container 2 and cross each other at the substantially central area of the wafers 1.

Figure 4B:
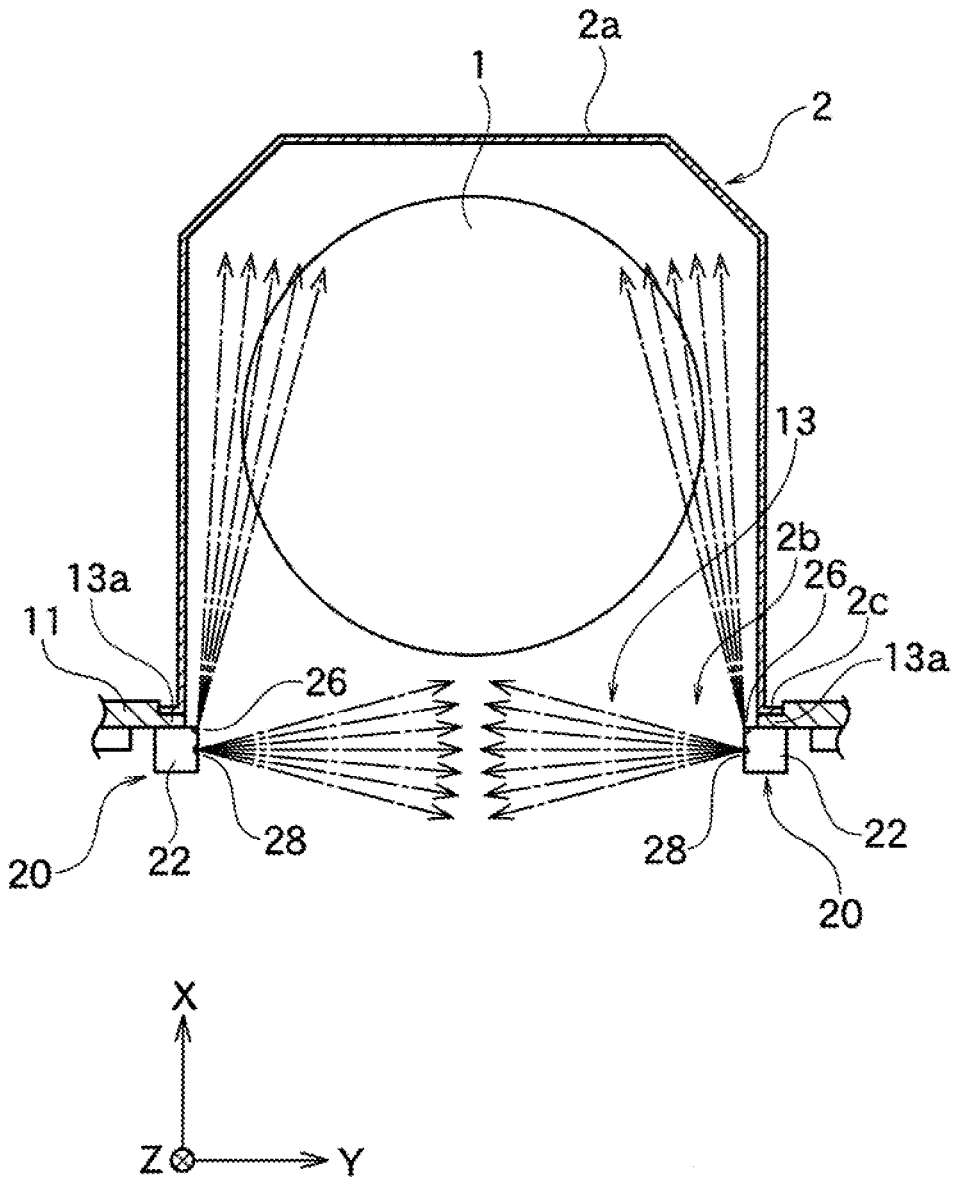
FIG. 4B is a cross-sectional view in a container similar to the container of FIG. 4A showing a gas purge unit according to another embodiment of the present invention.

In the present embodiment, however, the gases from the first nozzle outlets 26 flow to any direction in the container 2, and for example, flow to the periphery of the wafers 1 along the inner wall of the casing 2*a* as shown in FIG. 4B. Preferably, the gases from a pair of first nozzle outlets 26 and 26 flow symmetrically to the X-axis going through the center of the wafers 1, but may not necessarily flow symmetrically.

Further, in the present embodiment, each of the gases from the second nozzle outlets 28 and 28 preferably has the same flow rate, but may have a different flow rate. Similarly, each of the gases from the first nozzle outlets 26 and 26 preferably has the same flow rate, but may have a different flow rate.

Q1/Q2 may be variable, where Q1 is an airflow rate of the gases from the first nozzle outlets 26, and Q2 is an airflow rate of the gases from the second nozzle outlets 28. To adjust a ratio of the flow rates, the first nozzle outlets 26 and the second nozzle outlets 28 may have a different opening area, a partition plate inside the members 22, or the different number of the blowout holes.

In the present embodiment, the first nozzle outlet 26 and the second nozzle outlet 28 have the same length in the Z-axis direction and, as shown in FIG. 3D, preferably have substantially the same length in the Z-axis direction as the height of the opening 2*b* of the container 2 in the Z-axis direction. This structure allows the cleaning gas from the first nozzle outlet 26 to circulate the front and rear surfaces of all the wafers 1 housed in the container 2.

Note that, in the present embodiment, the first nozzle outlets 26 and the second nozzle outlets 28 do not necessarily have the same length in the Z-axis direction, and the second nozzle outlets 28 may have a length in the Z-axis direction that is longer than a length of the first nozzle outlets 26 in the Z-axis direction, for example. In this case, a dirty gas is effectively prevented from flowing from the inside of the wall 11 to the inside of the container 2. The first nozzle outlets 26 do not necessarily have a length in the Z-axis direction that is the same as a height of the opening 2*b* of the container 2 in the Z-axis direction, and may have a length in the Z-axis direction that is shorter than a height of the opening 2*b* of the container 2 in the Z-axis direction.

The gases from the first nozzle outlets 26 and the second nozzle outlets 28 may be any type of gas, such as inert gas of nitrogen gas, but at least need to be a gas (no particles or water) whose cleanliness is higher than that of the internal environment of the wall 11. The gases from the first nozzle outlets 26 and the second nozzle outlets 28 are preferably the same type and preferably have the same cleanliness, but may be different types and may have different cleanliness.

In the gas purge units 20 of the present embodiment, each of the second nozzle outlets 28 blowing a cleaning gas toward the opening surface of the opening 13 is arranged inside the wall 11 along both of the lateral sides 13*a* of the opening 13. Thus, the gas flow from the respective second nozzle outlets 28 generates a curtain flow that blocks the flow from the outside of the container 2 (the inside of the wall 11) into the container 2 via the opening 13.

This curtain flow is generated from the lateral sides 13*a* of the opening 13 parallel to the Z-axis direction and is thereby uniform in the vertical direction (Z-axis direction) of the container 2. The first nozzles 26 blowing a cleaning gas into the container 2 are also arranged along the lateral sides 13*a* of the opening 13, and a container-inward flow (an airflow directed into the container 2) is thereby vertically uniform in the container 2.

In the present embodiment, a uniform gas exchange can hence be achieved, particularly in the vertical direction, in the container 2. As a result, it is possible to obtain a uniform quality of objects to be processed, such as the multiple wafers 1 housed in the Z-axis direction in the container 2. Note that, as shown in FIG. 4A, gases blown from a pair of second nozzle outlets 28 arranged on both sides in the Y-axis direction are blown widely on the X-axis and Y-axis plane and collide with each other at the middle of the opening 13 in the Y-axis direction. Then, a part of the gases enters the container 2, and the other of the gases is partially pushed outward from the opening 13. It is accordingly possible to block an airflow trying to enter the container 2 from the outside of the container 2 (the inside of the wall 11) via the opening 13.

In the present embodiment, the first nozzle outlet 26 and the second nozzle outlet 28 are formed on the single bidirectional blowout member 22. This reduces the number of parts and contributes to downsizing of the unit 20.

The bidirectional blowout member 22 is disposed at least at one of the lateral sides 13*a* of the opening 13. In the present embodiment, however, the bidirectional blowout members 22 are arranged to face each other at both of the lateral sides 13*a* of the opening 13. In this structure, a curtain flow is generated from both of the lateral sides 13*a*, and this increases an effect of blocking an airflow from the outside into the container 2 via the opening 13. Also, cleaning gases directed into the container 2 are blown from two points (both of the lateral sides 13*a* of the opening 13), and the gas in the container 2 is thereby exchanged quickly and uniformly.

In the present embodiment, since a curtain flow can be formed by the second nozzle outlets 28, it is possible to remove a down-flow curtain nozzle 30 attached to the upper side 13*b* of the wall-side opening 13 shown in FIG. 1B and FIG. 3D, but this down-flow curtain nozzle 30 may be used simultaneously.

Incidentally, there is conventionally no second nozzle outlet 28 but only the down-flow curtain nozzle 30, and gas is possibly hard to reach the bottom of the container 2 as approaching it. For example, when the height of the opening 2*b* of the container 2 is 30 cm in the Z-axis direction, the downflow possibly reaches only about 15 cm from the above. This is probably because the downflow from the curtain nozzle 30 is diffused by a downflow from the FFU 40 mounted on the top of the intermediate chamber 60 shown in FIG. 1A.

In the present embodiment, as shown in FIG. 4A and FIG. 4B, the second nozzle outlets 28, which produce a curtain flow, are formed at both of the lateral sides 13*a* of the opening 13. Thus, even if the gas flows reach only about 15 cm from the respective second nozzle outlets 28, the gas flows from the respective second nozzle outlets 28 are combined and can cover the whole surface of the opening 13.

Note that, it is also conceivable that the lower side 13*c* is provided with a conventional curtain nozzle 30, but a curtain flow from below to above may collide with and be mixed with a downflow (cleanliness is low) from the FFU 40 shown in FIG. 1C, and the gas with low cleanliness may insufficiently be prevented from entering into the container 2.

Second Embodiment

Figure 4C:
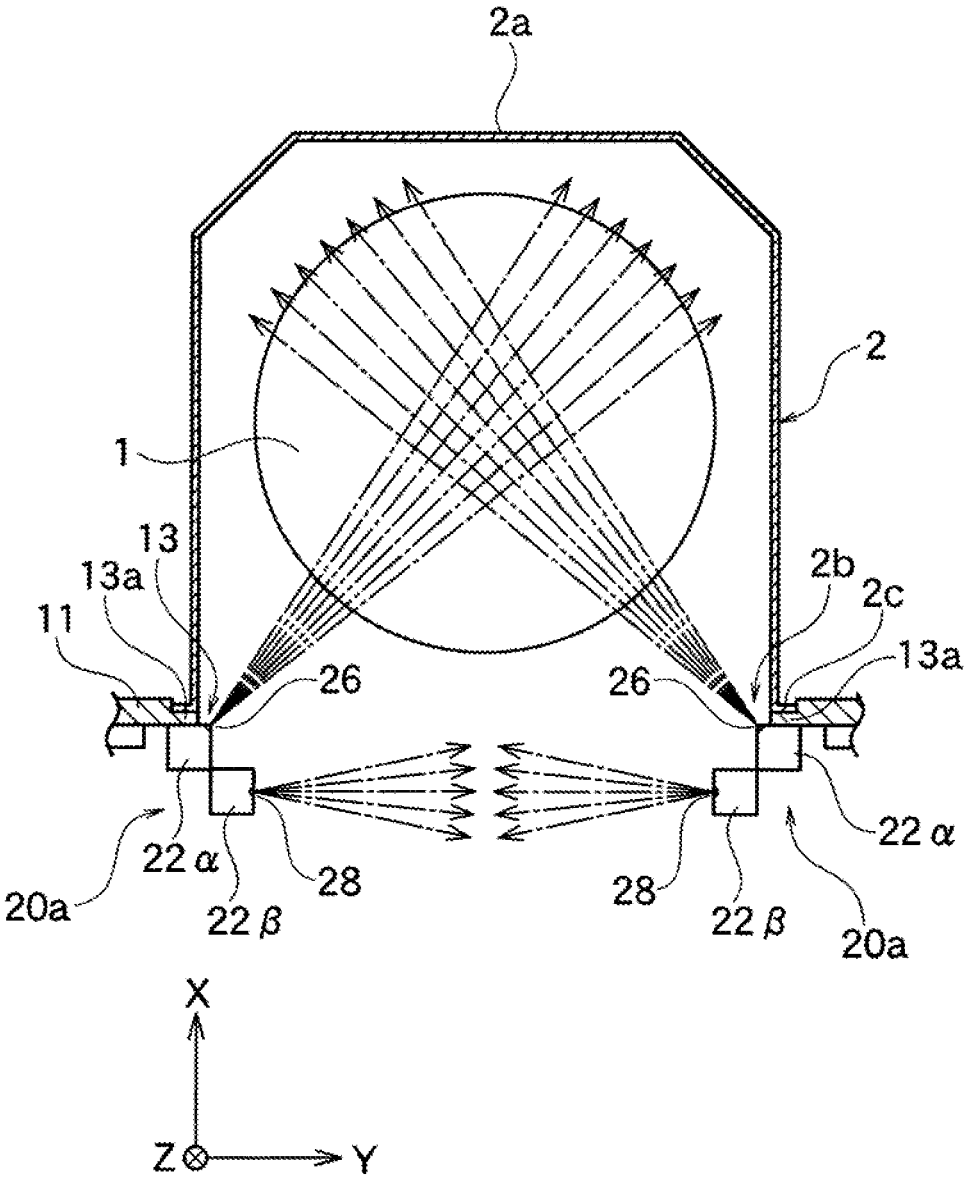
FIG. 4C is a cross-sectional view in a container similar to the container of FIG. 4A showing a gas purge unit according to another embodiment of the present invention.

FIG. 4C shows a combination of gas purge units 20*a* according to another embodiment of the present invention. In this embodiment, as shown in FIG. 4C, the first nozzle outlets 26 are formed on first-dedicated blowout members 22α, and the second nozzle outlets 28 are formed on second-dedicated blowout members 22β. At the first-dedicated blowout member 22α, the second nozzle outlet 28 is not formed, but only the first nozzle outlet 26 is formed. Similarly, at the second-dedicated blowout member 22β, the first nozzle outlet 26 is not formed, but only the second nozzle outlet 28 is formed.

In the present embodiment, the gas purge unit 20*a* consists of the first-dedicated blowout member 22*a* and the second-dedicated blowout member 22β, and the first-dedicated blowout members 22α are arranged closer to the opening 13 than the second-dedicated blowout members 22β. In this arrangement, a curtain flow from the second nozzle outlet 28 of the second-dedicated blowout member 22β is prevented from interfering with a container-inward flow from the first nozzle outlet 26 of the first-dedicated blowout member 22α, and both of the flows become smooth.

In the present embodiment, a common intake member 24 as shown in FIG. 1C may be connected to each of the first-dedicated blowout members 22α and the second-dedicated blowout members 22β, or gases may be supplied from different intake means.

The present embodiment has the same features and effects as First Embodiment, except that the gas purge unit 20*a* consist of the first-dedicated blowout member 22α and the second-dedicated blowout member 22β, and that the number of parts is larger compared to First Embodiment.

Third Embodiment

Figure 4D:
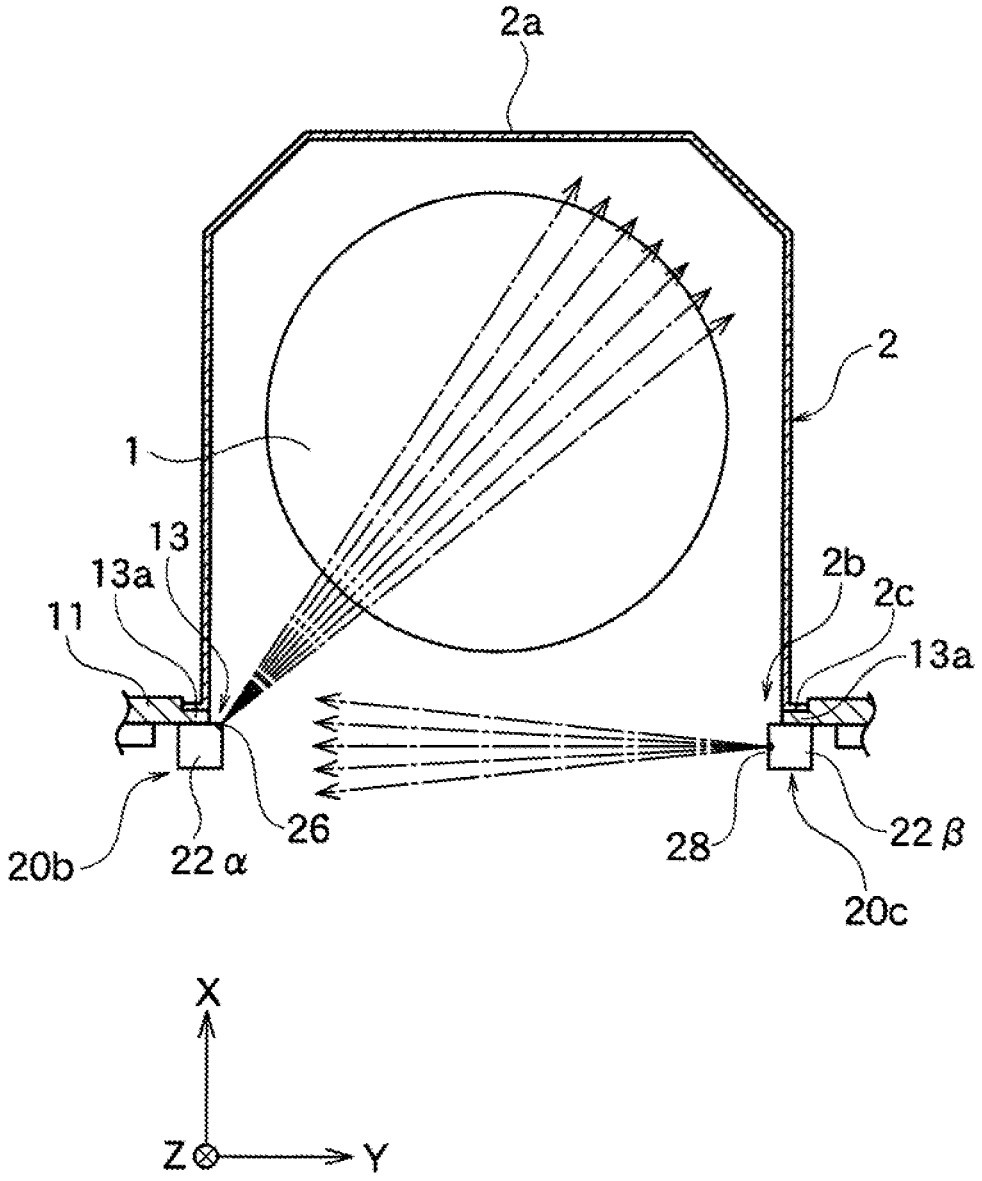
FIG. 4D is a cross-sectional view in a container similar to the container of FIG. 4A showing a gas purge unit according to another embodiment of the present invention.

FIG. 4D shows a combination of gas purge units 20*b* and 20*c* according to another embodiment of the present invention. In this embodiment, as shown in FIG. 4D, a first nozzle outlet 26 is formed on a first-dedicated blowout member 22α, and a second nozzle outlet 28 is formed on a second-dedicated blowout member 22β.

In this embodiment, the gas purge unit 20*b* having no second-dedicated blowout member 22β but having the first-dedicated blowout member 22α is fixed on the inner surface of the wall 11 in the Z-axis direction at one of the lateral sides 13*a* of the opening 13. Similarly, the gas purge unit 20*c* having no first-dedicated blowout member 22α but having the second-dedicated blowout member 22β is fixed on the inner surface of the wall 11 in the Z-axis direction at the other lateral side 13*a* of the opening 13.

In this embodiment, a container-inward flow is formed by only the first-dedicated blowout member 22α, and a curtain flow is formed by only the second-dedicated blowout member 22β. The other features and effects are the same as those of First Embodiment or Second Embodiment. Note that, the gas blown from the first nozzle outlet 26 of the first-dedicated blowout member 22α is not directed only as shown in FIG. 4D, but may flow along the inner wall of the casing 2*a* of the container 2 as shown in FIG. 4E, for example.

Figure 4E:
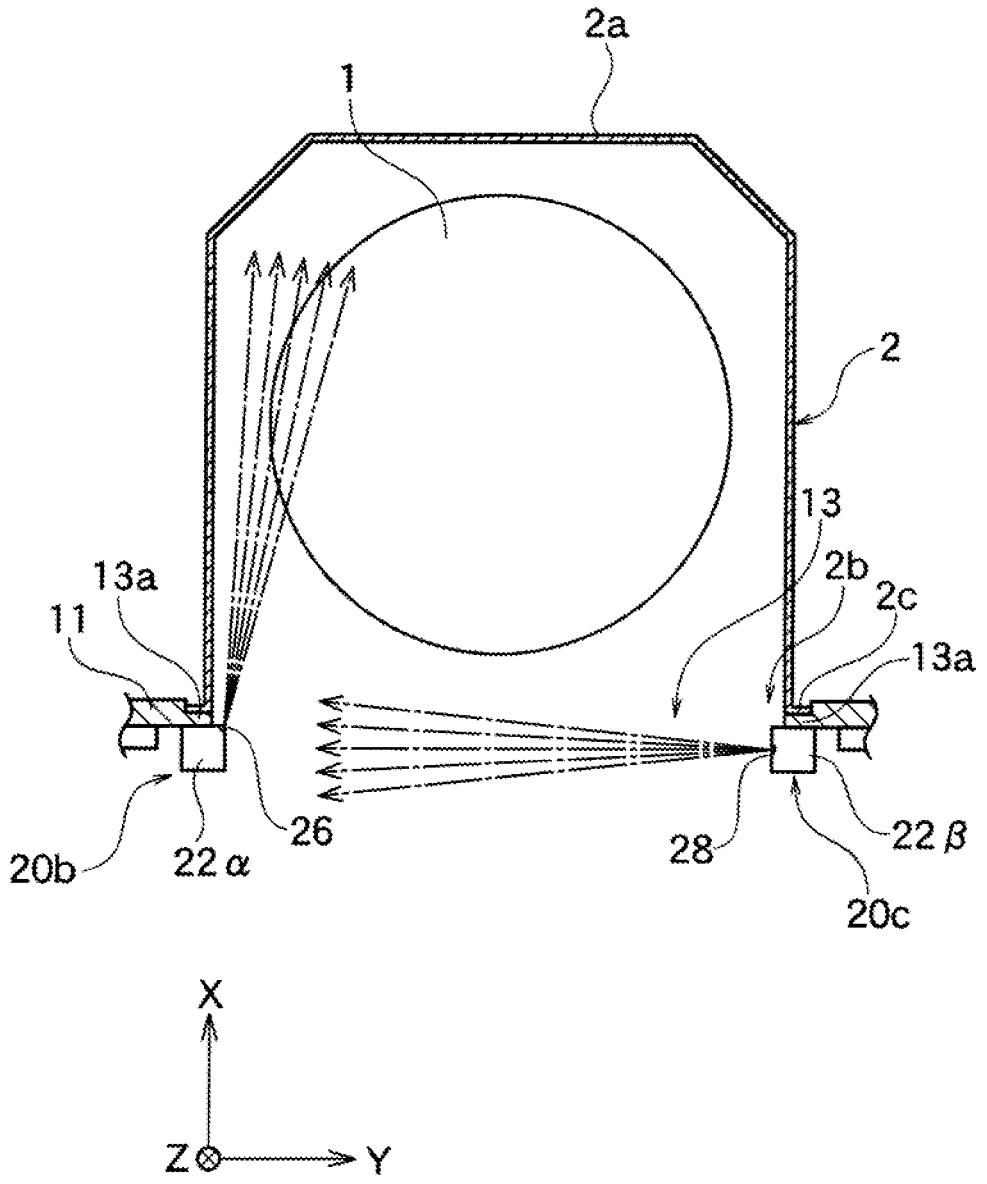
FIG. 4E is a cross-sectional view in a container similar to the container of FIG. 4A showing a gas purge unit according to another embodiment of the present invention.

As shown in FIG. 4E, a gas flow circulating clockwise along the wall surface of the casing 2*a* is formed in the container 2 by the gas flow from the first nozzle outlet 26 and the gas flow from the second nozzle outlet 28. As a result, gas exchange can be easily performed in the container 2 while a curtain effect is being demonstrated on the opening surface of the opening 13.

Fourth Embodiment

Figure 4F:
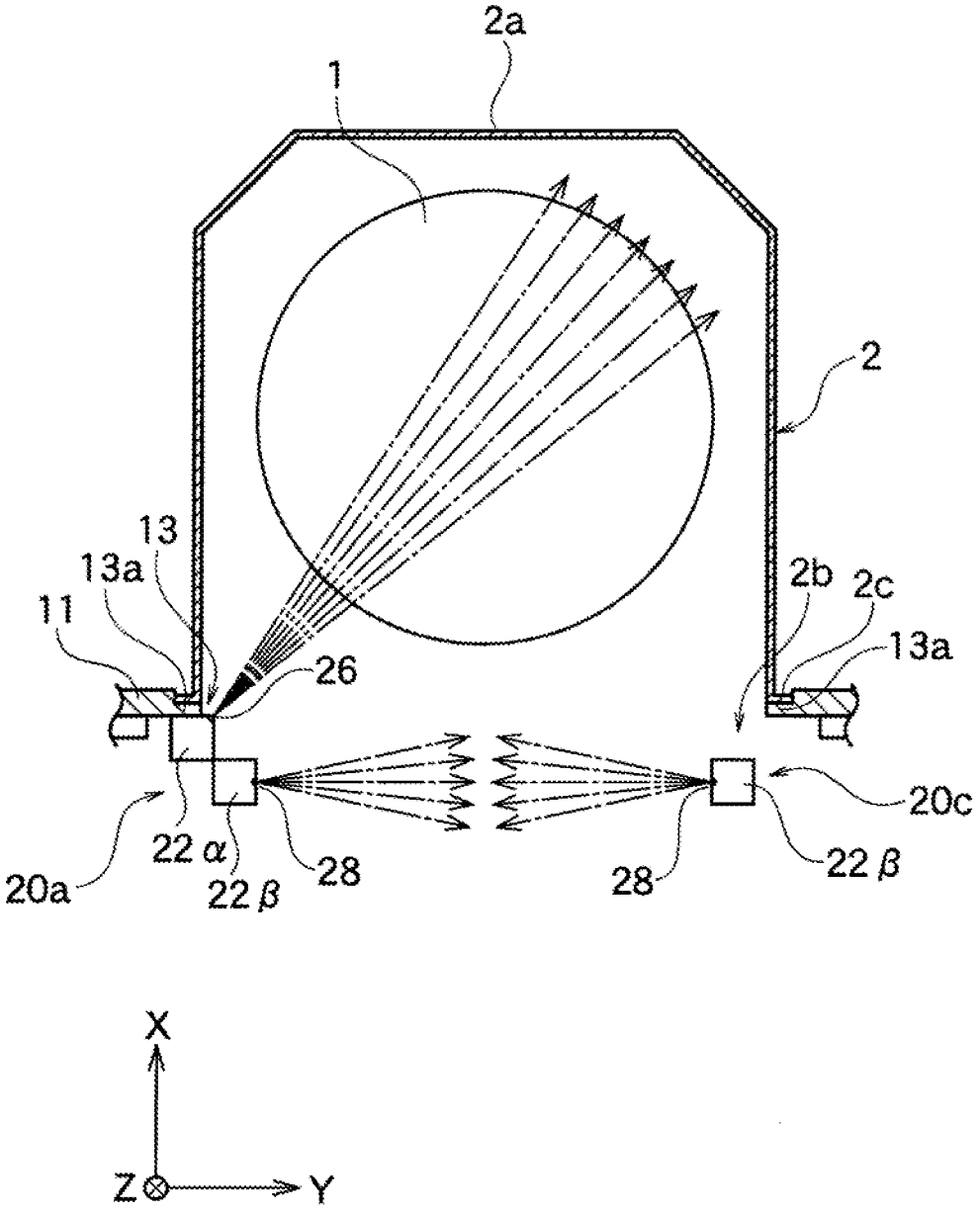
FIG. 4F is a cross-sectional view in a container similar to the container of FIG. 4A showing a gas purge unit according to another embodiment of the present invention.

FIG. 4F shows a combination of gas purge units 20*a* and 20*c* according to another embodiment of the present invention. In this embodiment, as shown in FIG. 4F, a first nozzle outlet 26 is formed on a first-dedicated blowout member 22α, and second nozzle outlets 28 are formed on second-dedicated blowout members 22β.

In this embodiment, the gas purge unit 20*a* having the second-dedicated blowout member 22β and the first-dedicated blowout member 22α is fixed on the inner surface of the wall 11 in the Z-axis direction at one of the lateral sides 13*a* of the opening 13. Also, the gas purge unit 20*c* having no first-dedicated blowout member 22α but having the second-dedicated blowout members 22β is fixed on the inner surface of the wall 11 in the Z-axis direction at the other lateral side 13*a* of the opening 13.

In this embodiment, a container-inward flow is formed by only the first-dedicated blowout member 22α, and a curtain flow is formed by a pair of second-dedicated blowout members 22β. The other features and effects are the same as those of First to Third Embodiments. Note that, as is the case with the above-mentioned embodiments, the gas blown from the first nozzle outlet 26 of the first-dedicated blowout member 22α is not directed only as shown in FIG. 4F.

Fifth Embodiment

Figure 4G:
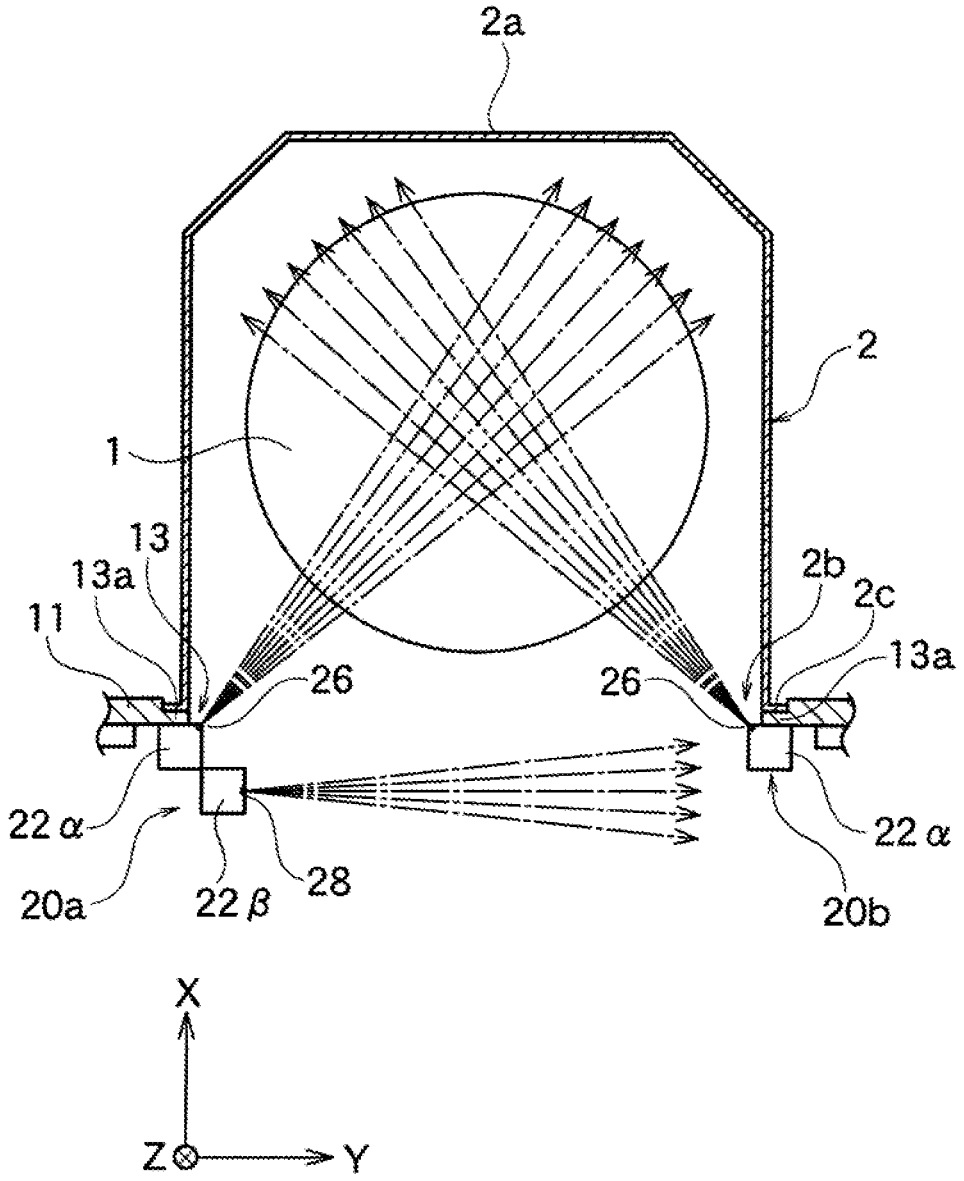
FIG. 4G is a cross-sectional view in a container similar to the container of FIG. 4A showing a gas purge unit according to another embodiment of the present invention.

FIG. 4G shows a combination of gas purge units 20*a* and 20*b* according to another embodiment of the present invention. In this embodiment, as shown in FIG. 4G, first nozzle outlets 26 are formed on first-dedicated blowout members 22α, and a second nozzle outlet 28 is formed on a second-dedicated blowout member 22β.

In this embodiment, the gas purge unit 20*a* having the second-dedicated blowout member 22β and the first-dedicated blowout member 22α is fixed on the inner surface of the wall 11 in the Z-axis direction at one of the lateral sides 13*a* of the opening 13. Also, the gas purge unit 20*b* having no second-dedicated blowout member 22β but having the first-dedicated blowout member 22α is fixed on the inner surface of the wall 11 in the Z-axis direction at the other lateral side 13*a* of the opening 13.

In this embodiment, a container-inward flow is formed by a pair of first-dedicated blowout members 22α, and a curtain flow is formed by only the second-dedicated blowout member 22β. The other features and effects are the same as those of First to Fourth Embodiments. Note that, as is the case with the above-mentioned embodiments, the gas blown from the first nozzle outlet 26 of the first-dedicated blowout member 22α is not directed only as shown in FIG. 4G.

Sixth Embodiment

Figure 4H:
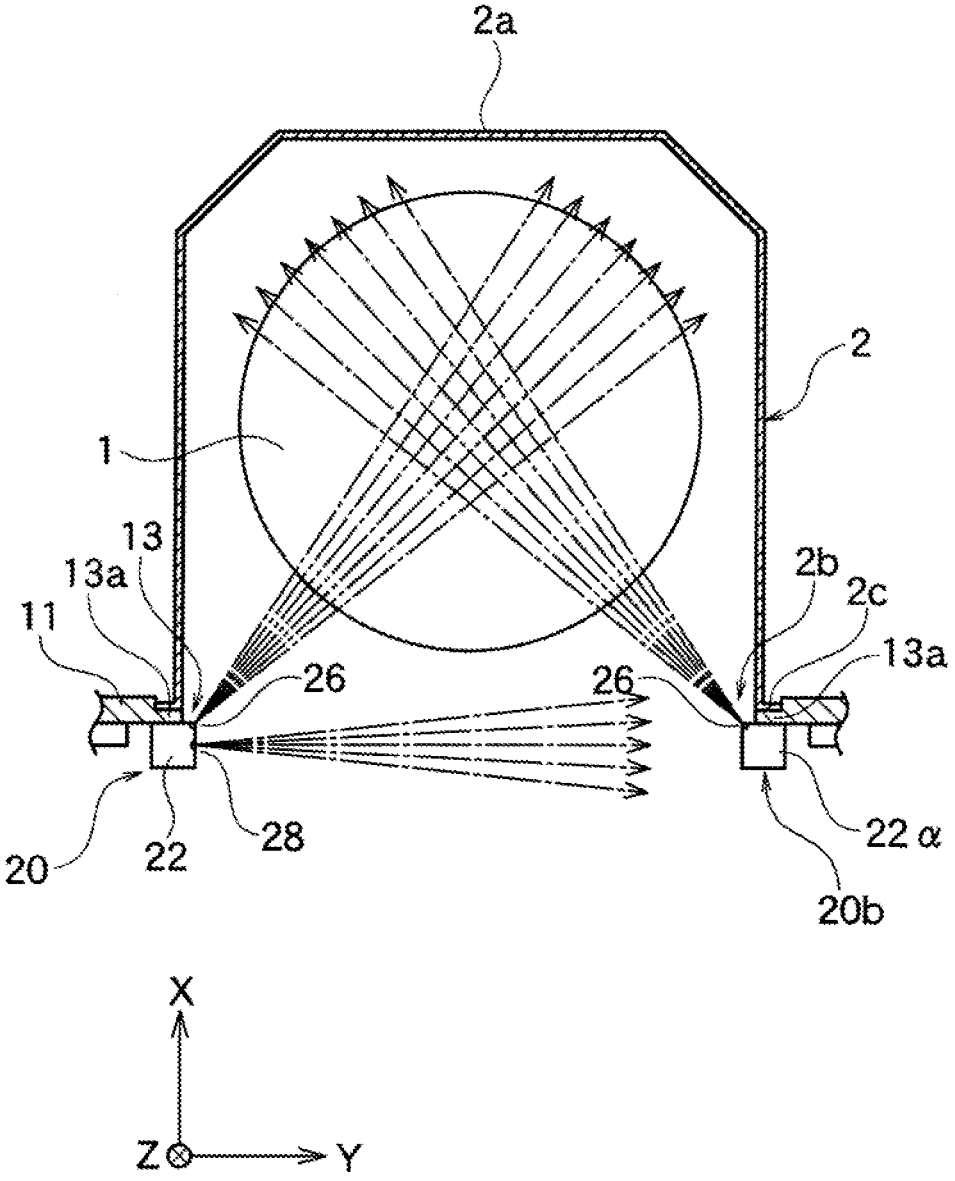
FIG. 4H is a cross-sectional view in a container similar to the container of FIG. 4A showing a gas purge unit according to another embodiment of the present invention.

FIG. 4H shows a combination of gas purge units 20 and 20*b* according to another embodiment of the present invention. In this embodiment, as shown in FIG. 4H, the gas purge unit 20 having a bidirectional blowout member 22 is fixed on the inner surface of the wall 11 in the Z-axis direction at one of the lateral sides 13*a* of the opening 13. Also, the gas purge unit 20*b* having no second-dedicated blowout member 22β but having a first-dedicated blowout member 22α is fixed on the inner surface of the wall 11 in the Z-axis direction at the other lateral side 13*a* of the opening 13.

In this embodiment, a container-inward flow is formed by a pair of first nozzle outlets 26. The other features and effects are the same as those of First to Fifth Embodiments. Note that, as is the case with the above-mentioned embodiments, the gas blown from the first nozzle outlet 26 of the bidirectional blowout member 22 is not directed only as shown in FIG. 4H.

Seventh Embodiment

Figure 4I:
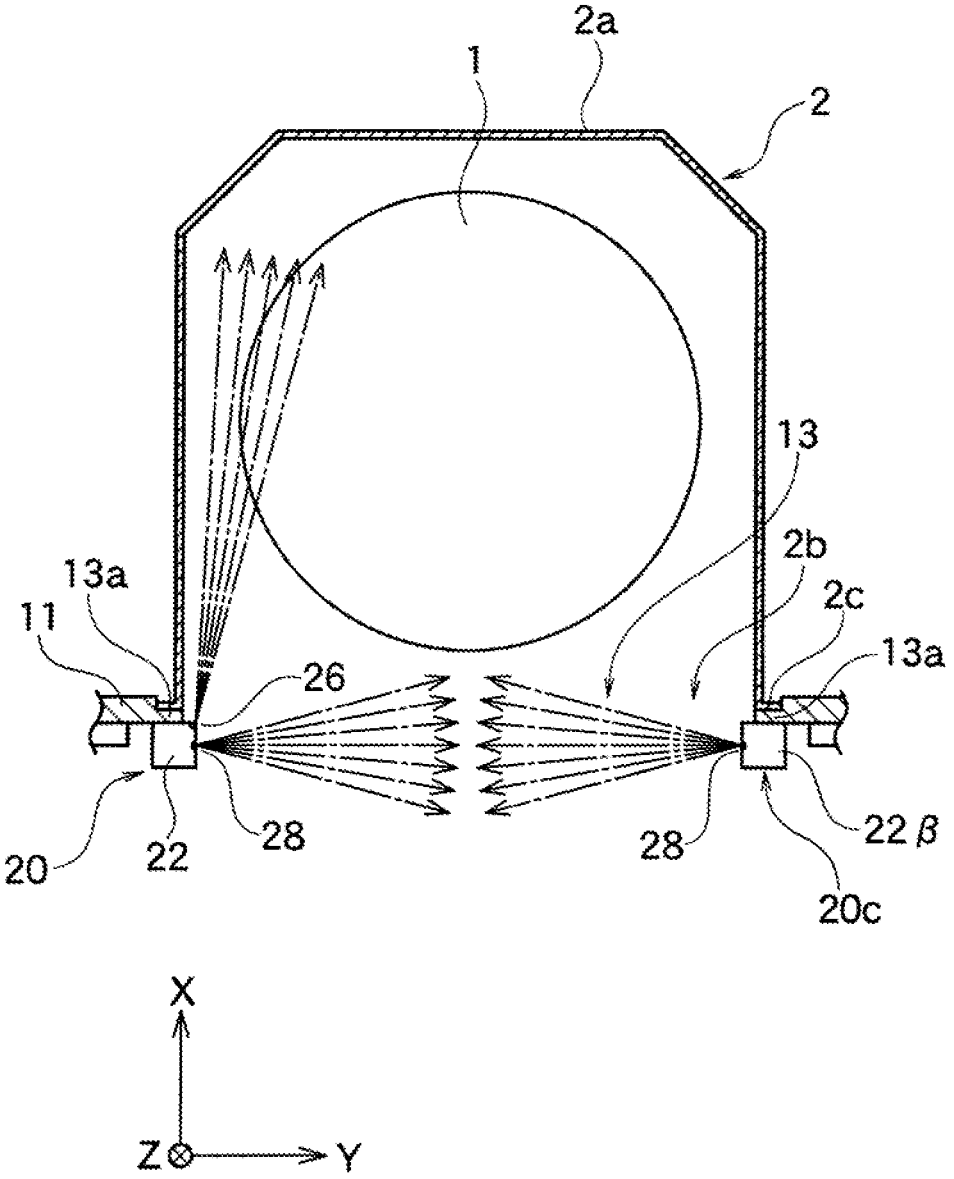
FIG. 4I is a cross-sectional view in a container similar to the container of FIG. 4A showing a gas purge unit according to another embodiment of the present invention.

FIG. 4I shows a combination of gas purge units 20 and 20*c* according to another embodiment of the present invention. In this embodiment, as shown in FIG. 4I, the gas purge unit 20 having a bidirectional blowout member 22 is fixed on the inner surface of the wall 11 in the Z-axis direction at one of the lateral sides 13*a* of the opening 13. Also, the gas purge unit 20*c* having no first-dedicated blowout member 22α but having a second-dedicated blowout member 22β is fixed on the inner surface of the wall 11 in the Z-axis direction at the other lateral side 13*a* of the opening 13.

In this embodiment, a container-inward flow is formed by only the first nozzle outlet 26. The other features and effects are the same as those of First to Sixth Embodiments. Note that, as is the case with the above-mentioned embodiments, the gas blown from the first nozzle outlet 26 of the bidirectional blowout member 22 is not directed only as shown in FIG. 4I.

Note that, the present invention is not limited to First to Seventh Embodiments mentioned above, but may variously be changed within the scope thereof. In the above-mentioned embodiments, for example, all of the second nozzle outlets 28 are configured to blow a cleaning gas along the opening surface of the opening 2*b*, but the second nozzle outlets 28 may be configured to blow a cleaning gas into the sealed transport container 2. In this case, the second nozzle outlet 28 is disposed farther from the opening 2*b* than the first nozzle outlets 26. A blowing direction of gas from the second nozzle outlet 28 into the sealed transport container 2 and a blowing direction of gas from the first nozzle outlet 26 into the sealed transport container 2 may be parallel or may not be parallel.

Eighth Embodiment

Figure 5:
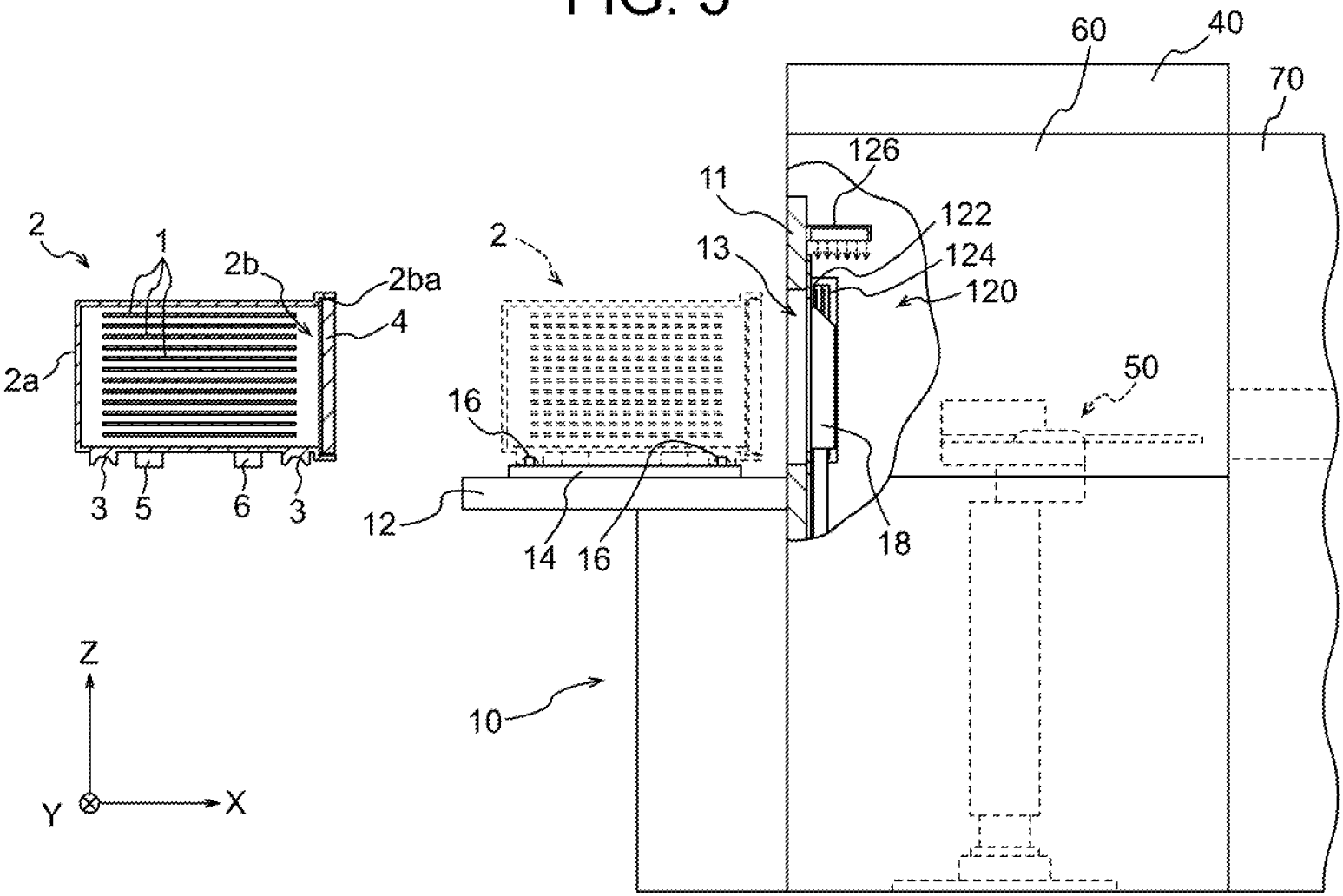
FIG. 5 is a schematic view of a partial cross-sectional view of a load port apparatus utilizing the gas purse unit according to First Embodiment.

As shown in FIG. 5, a load port apparatus 10 according to Eighth Embodiment of the present invention is connected to an intermediate chamber 60 of a minienvironment apparatus. In addition to a gas purge unit 120 mentioned below, the load port apparatus 10 includes a wall 11, an installation stand 12, and a movable table 14. The wall 11 extends vertically. The installation stand 12 is disposed on one side of the wall 11. The movable table 14 is movable on the installation stand 12 in the X-axis direction. In the figures, the X-axis represents a movable direction of the movable table 14, the Z-axis represents the vertical direction, and the Y-axis represents a perpendicular direction to the X-axis and the Z-axis.

A sealed transport container 2 can detachably be placed on the top of the movable table 14 in the Z-axis direction. The sealed transport container 2 consists of a pot, a FOUP, etc. for transporting a plurality of wafers 1 while they are sealed and stored, and has a casing 2*a*. A space for housing the wafers 1 (objects to be processed) is formed inside the casing 2*a*. The casing 2*a* has an approximately box-like shape with an opening on one of its surfaces present in the horizontal direction.

The sealed transport container 2 shown in the present embodiment is a wafer transport container conforming to SEMI standard and referred to as FOUP, but is not limited to the wafer transport container. Objects housed in the sealed transport container 2 are not limited to the wafers 1, and may be other objects needed to be housed in a clean environment.

The sealed transport container 2 also includes a lid 4 for sealing an opening 2*b* of the casing 2*a*. The opening 2*b* is approximately rectangular. The lid 4 has a rectangular flat plate shape that is approximately equal to the shape of opening 2*b*. Shelves (not shown) with multiple stages for horizontally holding the wafers 1 to be overlapped vertically (Z-axis direction) are arranged inside the casing 2*a*. The wafers 1 placed on the shelves are respectively housed inside the container 2 at regular intervals.

The load port apparatus 10 is an interface device for transporting wafers housed in a sealed state in the sealed transport container 2 into the intermediate chamber 60 while a clean state is being maintained. One or plural processing chambers 70 are connected airtightly in the intermediate chamber 60. The processing chamber 70 is not limited and is used, for example, for a vapor apparatus, a sputtering apparatus, an etching apparatus, and the like during semiconductor manufacturing process.

The intermediate chamber 60 houses a robot arm 50. A fan filter unit (FFU) 40 is mounted on the top of the intermediate chamber 60. A clean air or another gas flow by downflow from the FFU 40 into the intermediate chamber 60, and a local clean environment is produced. The intermediate chamber 60 often has a cleanliness that is lower than a cleanliness of the sealed transport container 2 filled with a cleaning gas, but has a cleanliness that is higher than a cleanliness of an external environment supposed as a normal indoor.

Figure 6:
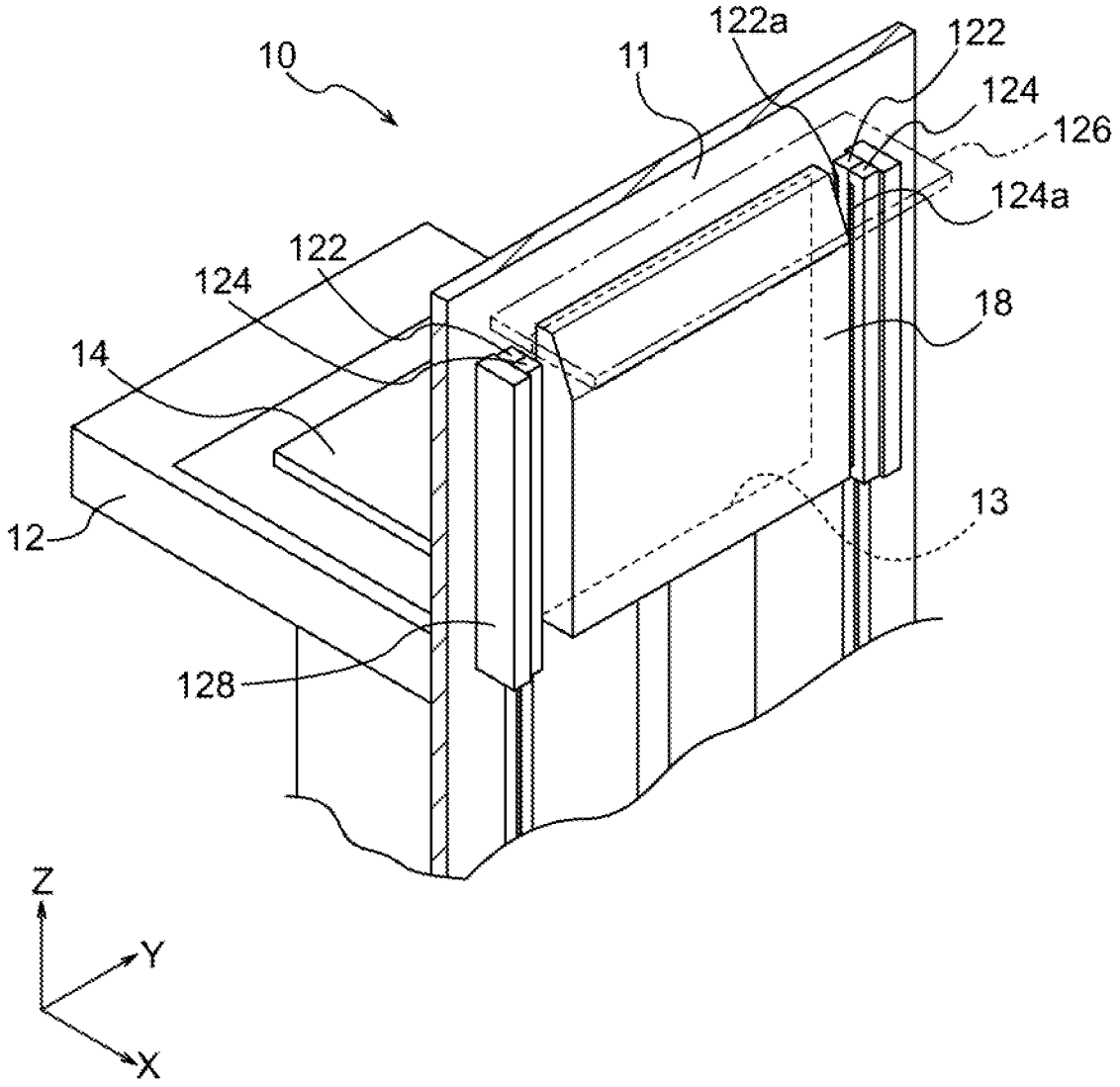
FIG. 6 is a schematic view of a partial cross-sectional view of the load port apparatus shown in FIG. 5.

The load port apparatus 10 has a door 18 for opening and closing a wall-side opening 13 of a wall 11. The wall 11 functions as a part of a casing for sealing the intermediate chamber 60 in a clean state. As shown in FIG. 6, the wall-side opening 13 has an approximately rectangular shape that is as large as the opening 2*b* of the sealed transport container 2.

As shown in FIG. 5 and FIG. 6, the load port apparatus 10 includes a gas purge unit 120. The gas purge unit 120 introduces a cleaning gas into the sealed transport container 2 via the opening 2*b* of the sealed transport container 2. The gas purge unit 120 includes a pair of first blowout members 122, a pair of second blowout members 124, and a third blowout member 126. The pair of first blowout members 122 and the pair of second blowout members 124 are arranged along a pair of lateral sides 2*bb* of the opening 2*b* (see FIG. 10). The third blowout member 126 is disposed along an upper side 2*ba* of the opening 2*b* (see FIG. 7D). The gas purge unit 120 is described below.

Hereinafter, FIG. 7A to FIG. 7D are used for explanation of an opening and closing motion of the wall-side opening 13 and the lid 4 by the door 18 and a motion of the load port apparatus 10 and the gas purge unit 120 attached thereto carried out correspondingly to the opening and closing motion by the door 18.

Figure 7A:
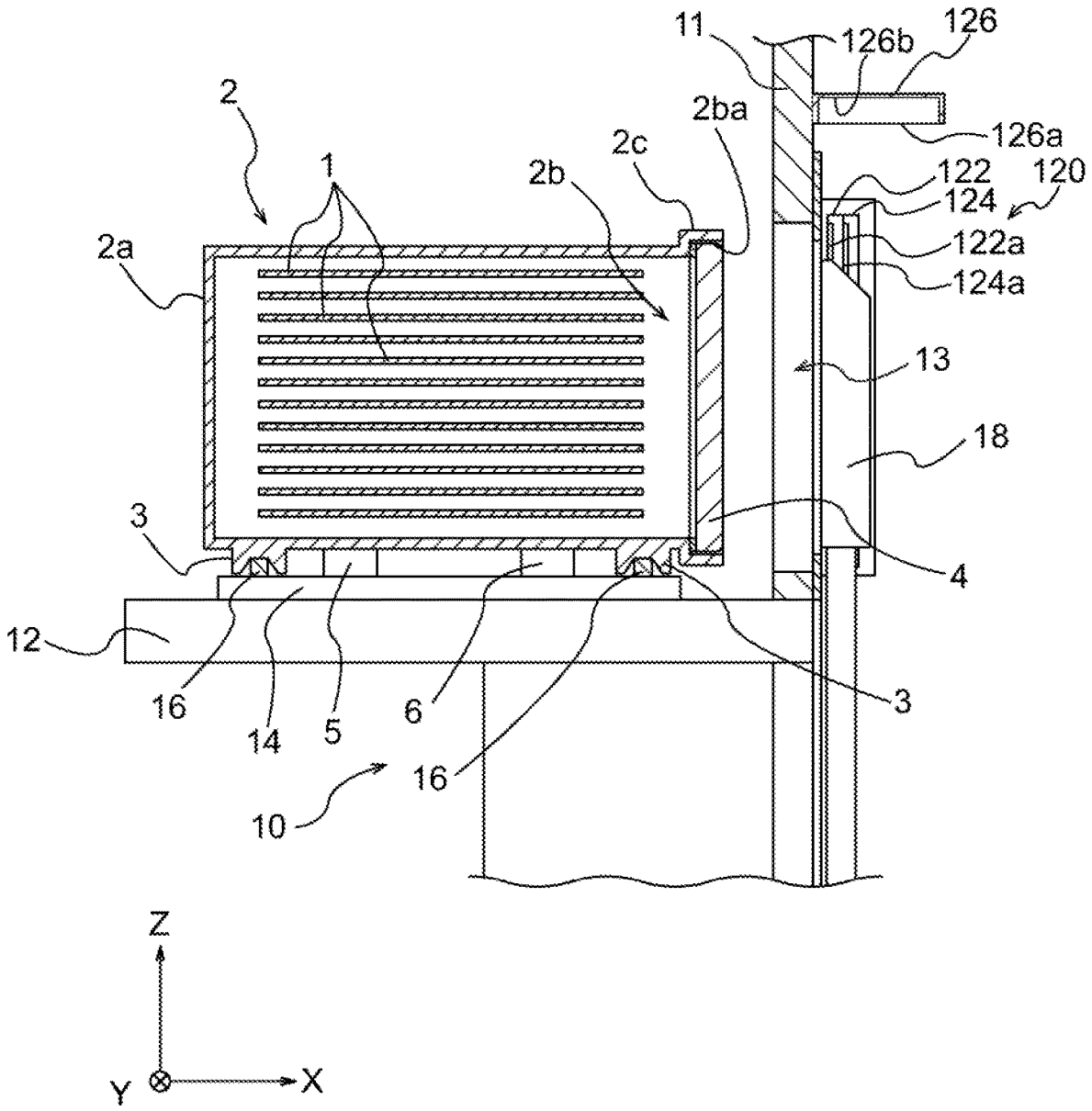
FIG. 7A is a schematic view illustrating a step where a lid of a sealed transport container is opened by a load port apparatus.

As shown in FIG. 7A, when the sealed transport container 2 is mounted on the movable table 14, positioning pins 16 are engaged with concaves of positioning portions 3 arranged on a bottom surface of the casing 2*a* of the sealed transport container 2, and a positional relation between the sealed transport container 2 and the movable table 14 is determined nonambiguously. During storage or transportation of the wafers 1, the sealed transport container 2 is internally sealed, and the surroundings of the wafers 1 are substantially maintained in a clean environment regardless of external environment of the sealed transport container 2.

Figure 7B:
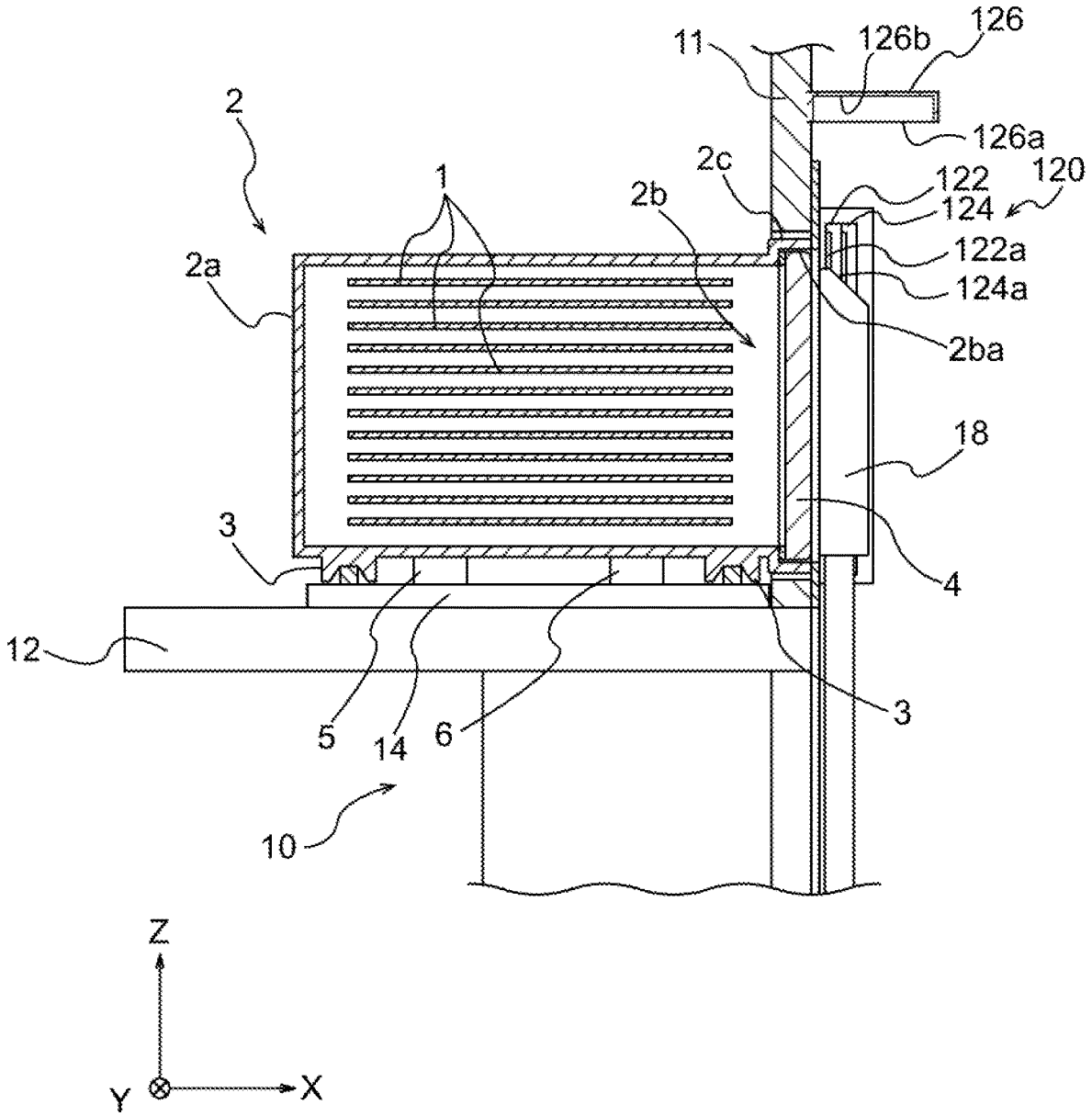
FIG. 7B is a schematic view illustrating the next step of FIG. 7A.

When the sealed transport container 2 is positioned to be placed on the top surface of the movable table 14, an intake port 5 and an exhaust port 6, which are formed on the bottom surface of the sealed transport container 2, are respectively airtightly connected to a bottom purge apparatus placed inside the movable table 14. Then, a bottom gas purge is performed via the intake port 5 and the exhaust port 6 positioned on the bottom of the sealed transport container 2. As shown in FIG. 7B, when the bottom gas purge is being performed, the movable table 14 moves in the X-axis direction, and opening edges 2*c* attached with the lid 4 airtightly sealing the opening 2*b* of the sealed transport container 2 enter the wall-side opening 13 of the wall 11.

Figure 7C:
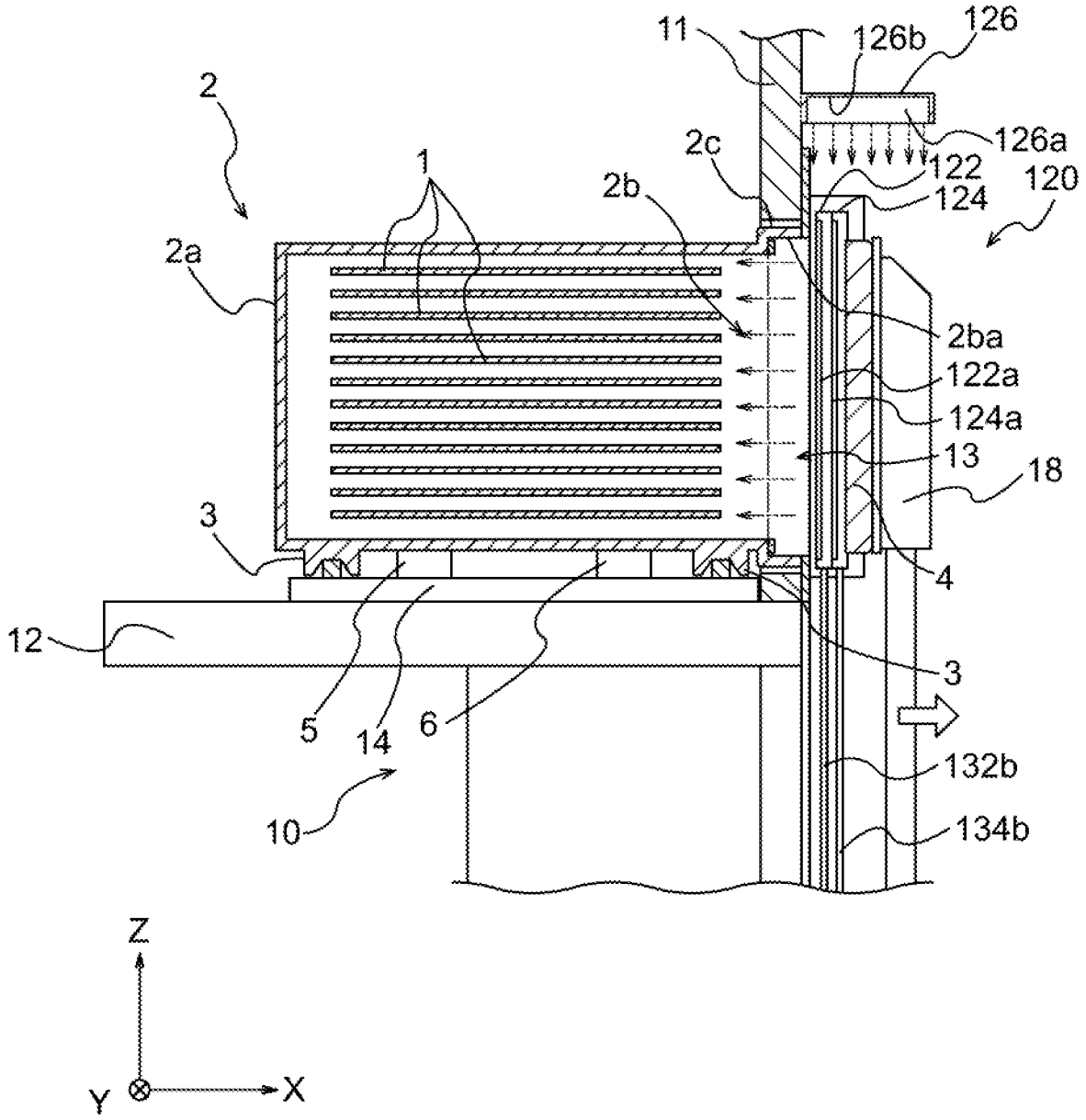
FIG. 7C is a schematic view illustrating the next step of FIG. 7B.

At the same time, the door 18 located inside the wall 11 (opposite to the movable table 14, where the sealed transport container 2 is installed) is engaged with the lid 4 of the sealed transport container 2. At that time, a space between the opening edges 2*c* and opening edges of the wall-side opening 13 is sealed by a gasket or so in a good state. Thereafter, as shown in FIG. 7C, the sealed transport container 2 and the wall 11 are internally connected by moving the door 18 together with the lid 4 in parallel along the X-axis direction or moving them rotationally, detaching the lid 4 from the opening edges 2*c*, opening the opening 2*b*, and connecting the opening 2*b* and the wall-side opening 13.

Even after the opening 2*b* is opened, the bottom gas purge may continuously be operated in the load port apparatus 10. After the opening 2*b* is opened, the first to third blowout members 122, 124, and 126 blow a cleaning gas (e.g., nitrogen gas, other inert gases, cleaned air) from the inside of the wall 11 toward the sealed transport container 2 (front purge). In the load port apparatus 10, the front purge may be carried out along with the bottom purge, or the front purge may be carried out while the bottom purge is being stopped.

Figure 7D:
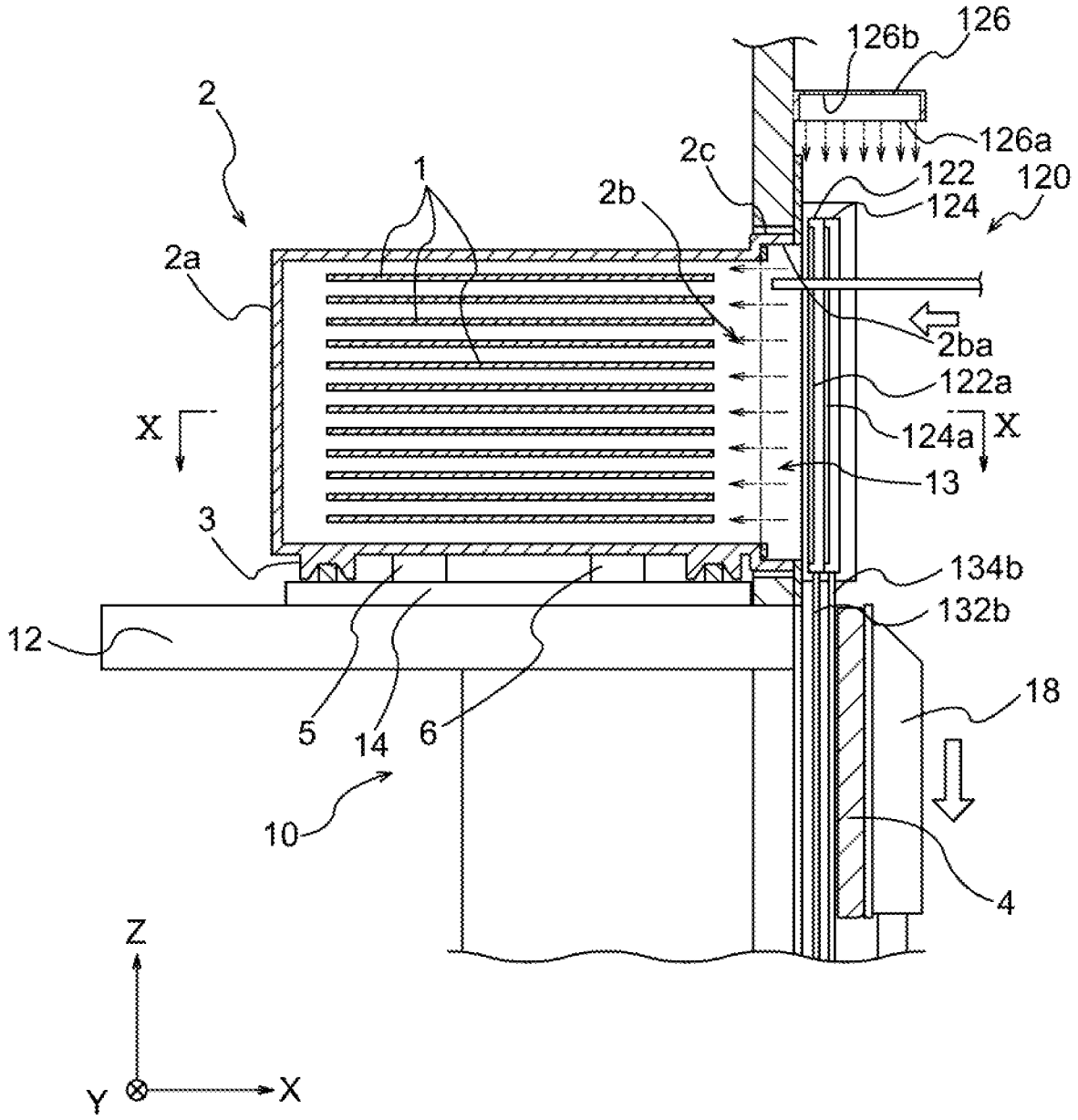
FIG. 7D is a schematic view illustrating the next step of FIG. 7C.

Next, as shown in FIG. 7D, when the door 18 is moved downward in the Z-axis in the wall 11, the opening 2*b* of the sealed transport container 2 is completely opened against the inside of the wall 11. After the opening 2*b* of the sealed transport container 2 is completely opened, the wafers 1 are delivered between the inside of the sealed transport container 2 and the inside of the wall 11 via the opening 2*b* and the wall-side opening 13 by a robot arm 50 disposed in the wall 11.

At that time, the sealed transport container 2 and the wall 11 (intermediate chamber 60 (see FIG. 5)) are internally cut off from outside air. Moreover, when the front purge is continuously carried out by the gas purge unit 120 of the load port apparatus 10, the sealed transport container 2 continues to have an inner environment that is cleaner than an inner environment of the wall 11. The opposite operation to the above is carried out so as to return the wafers 1 to the inside of the sealed transport container 2 and detach the sealed transport container 2 from the movable table 14.

Note that, the intake port 5, the exhaust port 6, the gas purge unit 120, and the like are enlarged in the figures for easy understanding compared with the sealed transport container 2, but are different from actual dimension ratio.

Next, the gas purge unit 120 for performing front purge according to the present embodiment is described with reference to the figures.

As shown in FIG. 6, the gas purge unit 120 is disposed around the wall-side opening 13. The first blowout members 122, the second blowout members 124, and the third blowout member 126 of the gas purge unit 120 are attached on the inner surface of the wall 11 (opposite surface to the installation stand 12) so as to avoid the door 18.

Figure 8:
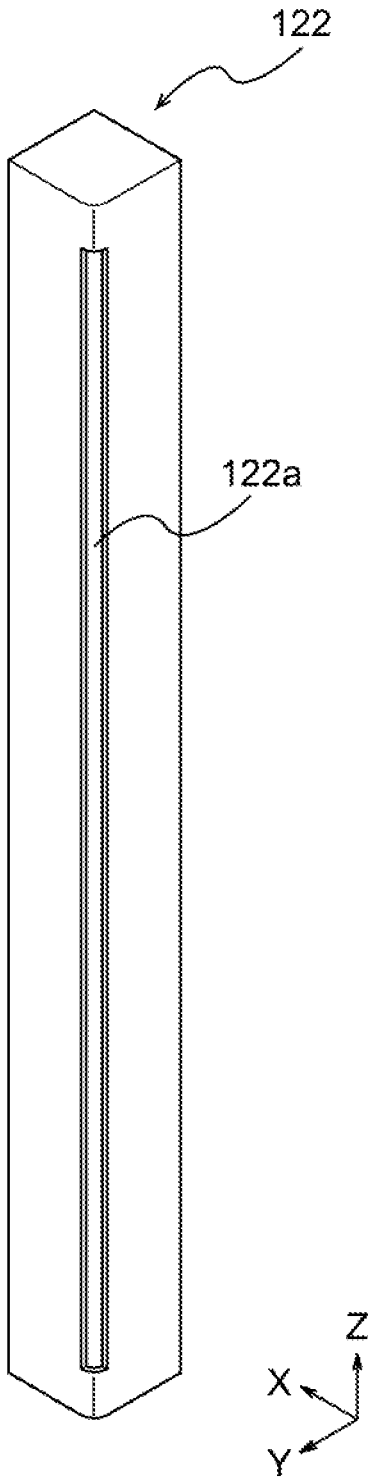
FIG. 8 is a schematic perspective view illustrating a first blowout member of a gas purge unit.
Figure 10:
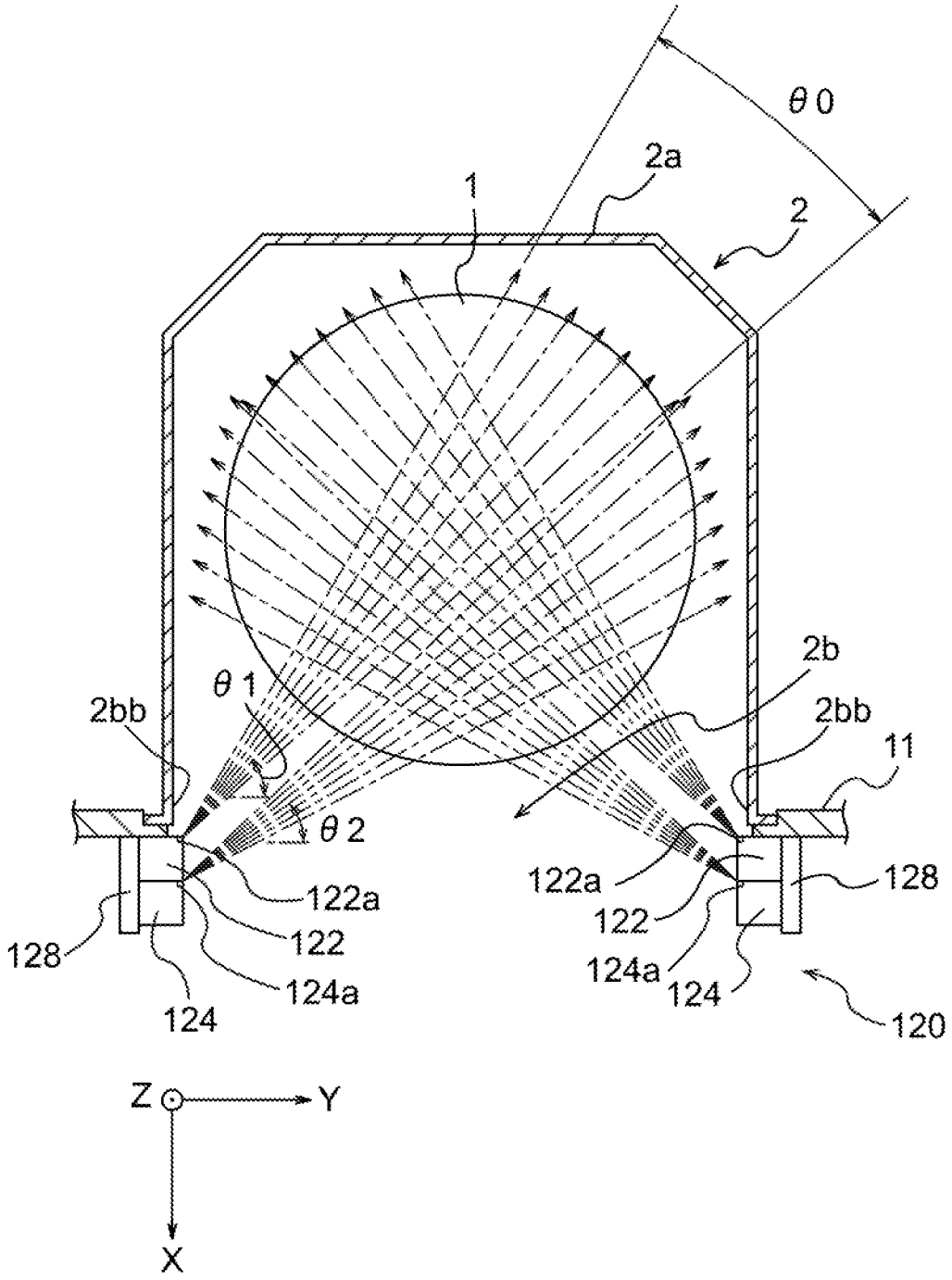
FIG. 10 is a schematic cross-sectional view of a horizontal cross section of a gas purge unit according to Eighth Embodiment.

As shown in FIG. 10, the first blowout member 122 includes a first nozzle outlet 122*a* and is disposed along the lateral side 2*b* b of the opening 2*b* extending in the Z-axis direction. The first nozzle outlet 122*a* blows a cleaning gas into the sealed transport container 2. As shown in FIG. 8 (a perspective view of the first blowout member 122), the first blowout member 122 is formed by an approximately cuboid tube member extending in the Z-axis direction, and the first nozzle outlet 122*a* formed by a slit-like through hole is formed at one of corners extending in the Z-axis direction. An opening angle of the first nozzle outlet 122*a* on the XY plane is determined so that a gas blowout angle θ0 shown in FIG. 10 is preferably 10 to 45 degrees, more preferably 25 to 35 degrees, but the first nozzle outlet 122*a* may have any opening angle on the XY plane.

As shown in FIG. 10, the second blowout member 124 includes a second nozzle port 124*a* and is disposed along the lateral side 2*b* b of the opening 2*b* extending in the Z-axis direction. The second nozzle port 124*a* blows a cleaning gas into the sealed transport container 2. The second blowout member 124 is disposed in parallel to the first blowout member 122, but the second nozzle port 124*a* of the second blowout member 124 is disposed farther from the opening 2*b* than the first nozzle port 122*a* of the first blowout member 122.

As shown in FIG. 6, the second blowout member 124 has a shape that is similar to a shape of the first blowout member 122 shown in FIG. 8. That is, the second blowout member 124 is formed by a rectangular-parallelepiped tubular member that extends in the Z-axis direction and has the second nozzle port 124*a* with a slit shape at one corner extending in the Z-axis direction. An opening angle of the second nozzle port 124*a* on the XY plane is determined similarly to and is preferably approximately the same as an opening angle of the first nozzle port 122*a* on the XY plane, but is not necessarily completely the same as an opening angle of the first nozzle port 122*a* on the XY plane.

As shown in FIG. 10, two pairs of blowout members (one first blowout member 122 and one second blowout member 124) are arranged in total in the gas purge unit 120 correspondingly to each of the lateral sides 2*b* b of the opening 2*b*. The first blowout members 122 and the second blowout members 124 are arranged symmetrically on both sides of the opening 2*b* in the Y-axis direction, but this is not the only one arrangement of the first blowout member 122 and the second blowout member 124. In other gas purge units, for example, one pair or three or more pairs of blowout members may be employed, or the first and second blowout members 122 and 124 may be arranged asymmetrically.

The first and second blowout members 122 and 124 are attached to the inner surface of the wall 11 via a plate-like attachment member 128 as shown in FIG. 6, but this is not the only one method of attaching the first and second blowout members 122 and 124. For example, the first and second blowout members 122 and 124 may directly be fixed to the wall 11 or may be suspended from above. In the gas purge unit 120, the first and second blowout members 122 and 124 are arranged to contact each other, and downsizing is thereby achieved.

As shown in FIG. 10, both of the first nozzle port 122*a* of the first blowout member 122 and the second nozzle port 124*a* of the second blowout member 124 blow a cleaning gas into the sealed transport container 2. That is, center positions of the gas blowout from the first nozzle port 122*a* and the second nozzle port 124*a* on the XY plane are respectively tilted from the Y-axis direction (a parallel direction to the opening surface) to the inner direction of the sealed transport container 2 at a predetermined angle θ1 and a predetermined angle 82. The angle θ1 of the gas blowout of the first nozzle port 122*a* may be the same as or larger than the angle 82 of the gas blowout of the second nozzle port 124*a*.

Figure 9A:
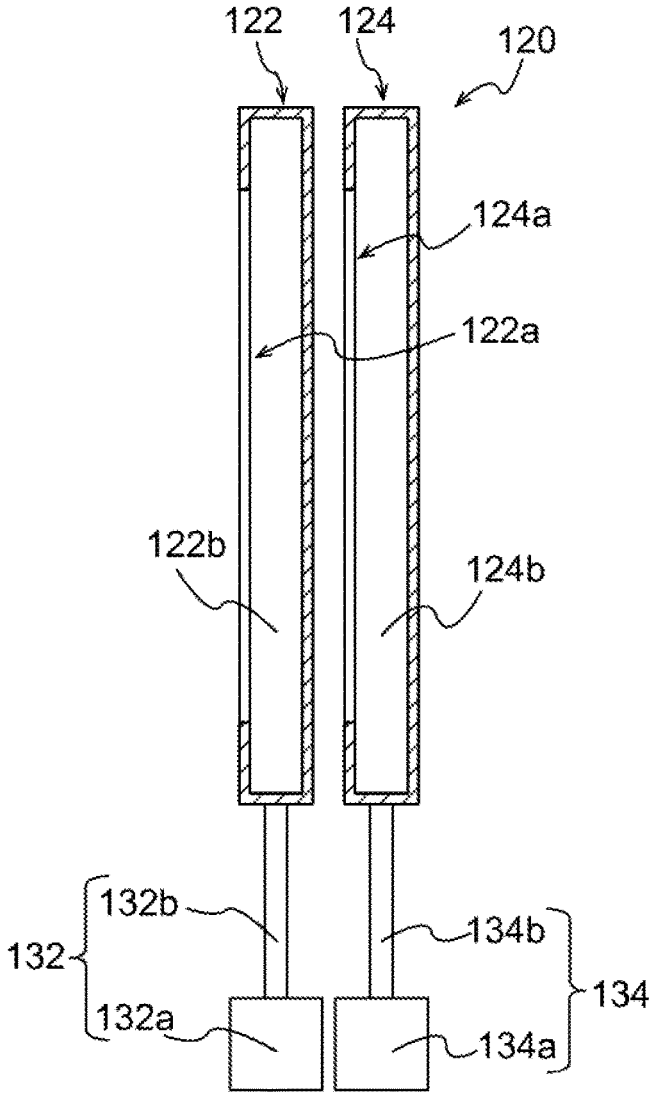
FIG. 9A is a schematic cross-sectional view illustrating first and second blowout members and supply sections of cleaning gases.

FIG. 9A is a schematic cross-sectional view illustrating an inner structure of the first blowout member 122 and the second blowout member 124. The first blowout member 122 includes a first channel 122*b*. The first channel 122*b* is a channel for cleaning gas and is connected to the first nozzle port 122*a*. The first channel 122*b* is supplied with a cleaning gas from a first gas-supply section 132 including a first gas-supply chamber 132*a* and a first gas lateral pipe 132*b*. The first gas-supply chamber 132*a* includes a tank filled with a cleaning gas at a predetermined pressure, a control valve capable of adjusting a gas flow rate, and the like. The first gas lateral pipe 132*b* connects between the first gas-supply chamber 132*a* and the first channel 122*b* of the first blowout member 122. Note that, when two first blowout members 122 are contained as shown in FIG. 10, the first gas lateral pipe 132*b* connects between one first gas-supply chamber 132*a* and the first channels 122*b* of two first blowout members 122.

As with the first blowout member 122, the second blowout member 124 includes a second channel 124*b* as shown in FIG. 9A. The second channel 124*b* is a channel for cleaning gas and is connected to the second nozzle port 124*a*. The second channel 124*b* is supplied with a cleaning gas from a second gas-supply section 134 including a second gas-supply chamber 134*a* and a second-gas lateral pipe 134*b*. As with the first gas-supply chamber 132*a*, the second gas-supply chamber 134*a* includes a tank filled with a cleaning gas at a predetermined pressure, a control valve capable of adjusting a gas flow rate, and the like. The second-gas lateral pipe 134*b* connects between the second gas-supply chamber 134*a* and the second channel 124*b* of the second blowout member 124. The second gas lateral pipe 134*b* connects between one second gas-supply chamber 134*a* and two second channels 124*b*. This is also the same as the first gas lateral pipe 132*b*.

In the present embodiment, the first gas-supply section 132, which supplies a cleaning gas to the first blowout member 122, and the second gas-supply section 134, which supplies a cleaning gas to the second blowout member 124, are independent from each other as shown in FIG. 9A, and the gas purge unit 120 can thereby separately control the discharge of cleaning gas from the first nozzle outlet 122*a* and the discharge of cleaning gas from the second nozzle outlet 124*a*.

In the gas purge unit 120, the first blowout member 122 and the second blowout member 124 may discharge a cleaning gas at different timings. For example, as shown in FIG. 7D, when the lid 4 is opened completely and is withdrawn from the opening surface of the opening 2*b* in the Z-axis direction along with the door 18 holding the lid 4 (the door 18 is lowered), a cleaning gas is discharged from both of the first blowout member 122 and the second blowout member 124. On the other hand, as shown in FIG. 7C, when the lid 4 is incompletely opened and partially overlapped with the door 18 holding the lid 4 in the Z-axis direction on the opening surface of the opening 2*b*, a cleaning gas is discharged from only the first blowout member 122 and is not discharged from the second blowout member 124 disposed closer to the door 18.

In this way, the discharge timings of cleaning gas from the first blowout member 122 and the second blowout member 124 are controlled separately based on positions of the lid 4 and the door 18. Thus, a consumption amount of the gas can be adjusted as necessary.

The gas purge unit 120 shown in FIG. 9A can separately change an airflow rate of a cleaning gas discharged from the first nozzle outlet 122*a* of the first blowout member 122 and an airflow rate of a cleaning gas discharged from the first nozzle outlet 124*a* of the second blowout member 124. Either of the flow rates may be larger than the other flow rate, or the flow rates may be equal to each other. In the gas purge unit 120, for example, when a cleaning gas is discharged from both of the first blowout member 122 and the second blowout member 124 as shown in FIG. 10, the flow rate of the cleaning gas discharged from the first nozzle outlet 122*a* can be larger than the flow rate of the cleaning gas discharged from the second nozzle outlet 124*a*. When the second blowout member 124 disposed farther from the opening 2*b* has a small flow rate, a gas having a low cleanliness in the intermediate chamber 60 can be prevented from entering the sealed transport container 2.

Figure 9B:
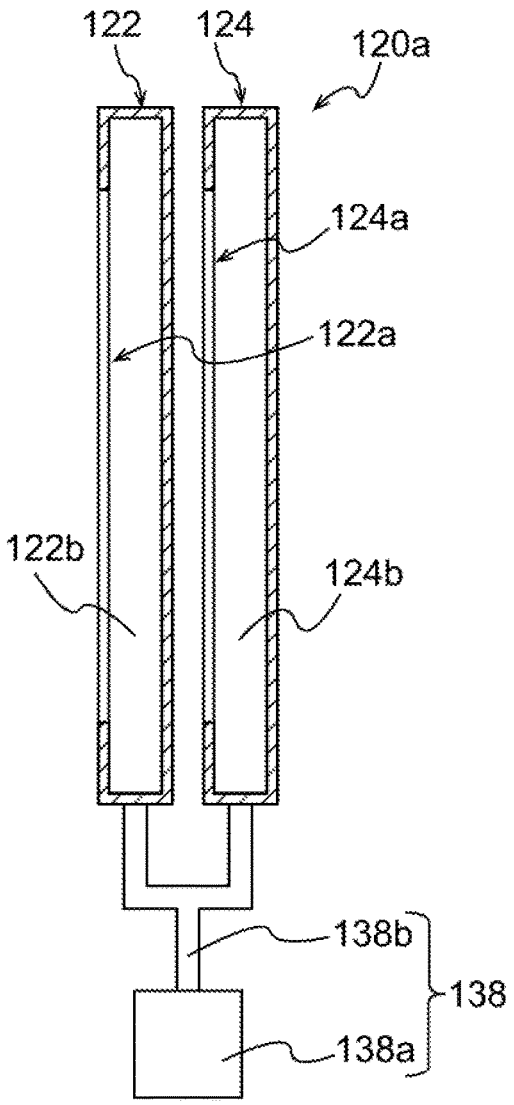
FIG. 9B is a schematic cross-sectional view illustrating first and second blowout members and a supply section of a cleaning gas according to a variation of FIG. 9A.

Instead of the gas purge unit 120 shown in FIG. 9A, the load port apparatus 10 may employ a gas purge unit 120*a* according to a variation shown in FIG. 9B. The gas purge unit 120*a* includes a common gas-supply section 138. The common gas-supply section 138 supplies a cleaning gas to the first blowout member 122 and the second blowout member 124. The common gas-supply section 138 includes a common gas-supply chamber 138*a* and a branched gas-supply pipe 138*b*. As with the first and second gas-supply chambers 132*a* and 134*a*, the common gas-supply chamber 138*a* includes a tank filled with a cleaning gas at a predetermined pressure, a control valve capable of adjusting a gas flow rate, and the like.

The branched gas-supply pipe 138*b* connects the common gas-supply chamber 138*a*, the first channel 122*b* of the first blowout member 122, and the second channel 124*b* of the second blowout member 124. Unlike the gas purge unit 120, the gas purge unit 120*a* is hard to control discharge timings of cleaning gas of the first and second blowout members 122 and 124 in a separate manner, but the gas purge unit 120*a* can be simplified as a whole by reducing the number of gas-supply chambers or a total length of pipes.

As shown in FIG. 6 and FIG. 7D, the third blowout member 126 of the gas purge unit 120 is disposed along the upper side 2*b* a of the opening 2*b*, and the first to third blowout members 122, 124, and 126 are arranged to surround the opening 2*b* and the wall-side opening 13 in a U-shape manner. The third blowout member 126 includes a third nozzle port 126*a*. The third nozzle port 126*a* blows a cleaning gas along the opening surface of the sealed transport container 2. In FIG. 6, the third blowout member 126 is perspective for easy view of other members.

The third blowout member 126 is formed by a rectangular-parallelepiped tubular member extending in the Y-axis direction. The third nozzle port 126*a* (through hole) is formed on a surface of the third blowout member 126 facing downward. As shown in FIG. 7D etc., the third blowout member 126 contains a third channel 126*b*. The third channel 126*b* is a channel for cleaning gas connected to the third nozzle port 126*a*. The third channel 126*b* is supplied with a cleaning gas from the first or second gas-supply section 132 or 134 shown in FIG. 9A or another gas-supply section (not shown).

As shown in FIG. 7D, a cleaning gas discharged from the third nozzle port 126*a* forms a downward airflow along an opening surface parallel to the YZ plane. The third nozzle port 126*a* is formed with any distance from the opening 2*b*.

The first to third nozzle ports 122*a*, 124*a*, and 126*a* blow any cleaning gas, such as an inert gas of nitrogen gas, argon gas, etc. and a cleaned air. For example, this cleaning gas is preferably a nitrogen gas. Cleaning gases supplied to the first to third nozzle ports 122*a*, 124*a*, and 126*a* may have the same component and purity or may have different components and purities. The intermediate chamber 60 according to the embodiment is filled with a cleaned air, but may be filled with an inert gas, a mixed gas of air and another gas, or the like.

In the gas purge unit 120 according to the present embodiment, the first nozzle port 122*a* and the second nozzle port 124*a*, both of which blow a cleaning gas into the sealed transport container 2, are arranged in parallel along the lateral sides 2*bb* of the opening 2*b*. Thus, the gas flows from the first nozzle port 122*a* and the second nozzle port 124*a* are generated from the lateral sides 2*bb* of the opening 2*b* of the container 2 and are thereby a vertically uniform flow in the Z-axis of the container 2.

In the present embodiment, a gas exchange can be achieved uniformly, particularly vertically in the Z-axis direction. It is consequently possible to achieve a uniform quality of objects to be processed, such as the wafers 1 housed in the container 2. The present embodiment has the above-mentioned features and can thereby produce layers of cleaning gases going into the container 2 and effectively prevent a gas having a low cleanliness in the intermediate chamber 60 from being dragged into the container 2. Since the first nozzle port 122*a* and the second nozzle port 124*a* are arranged with different distances from the opening 2*b* in the X-axis direction and are arranged in parallel to each other, a thick layer of cleaning gases is formed, and the container 2 can efficiently be cleaned.

Since the airflow from the second nozzle port 124*a* is also directed into the container 2, a cleaning gas from the second nozzle port 124*a* is also easily introduced into the container 2, and a cleaning gas blown from the first nozzle port 122*a* is also pushed into the container 2. Thus, the cleaning gases can efficiently be introduced into the container 2 compared to only the first nozzle port 122*a*.

In the gas purge unit 120, a pair of blowout members (one first blowout member 122 and one second blowout member 124) is arranged correspondingly to each of the lateral sides 2*b* b of the opening 2*b*, and cleaning gases can uniformly be introduced into the container 2 compared to when a cleaning gas is discharged from one side. As shown in FIG. 10, gases from the pair of second nozzle ports 124*a* arranged on both sides in the Y-axis direction are blown widely on the XY plane and collide with each other in the middle of the opening 2*b* in the Y-axis direction, and a part of the gases enter the container 2 and the rest of the gases is partially pushed outward from the opening 2*b*. It is accordingly possible to block an airflow trying to enter the container 2 from the outside of the container 2 (inner side of the wall 11) via the opening 2*b*.

The gas purge unit 120 includes the third blowout member 126 disposed along the upper side 2*b* a of the opening 2*b*, and the third blowout member 126 includes the third nozzle outlet 26*a* configured to blow a cleaning gas along the opening surface. Unlike cleaning gases discharged from the first and second nozzle ports 122*a* and 124*a*, a cleaning gas blown from the third nozzle port 26*a* is not introduced very much into the container 2. However, a cleaning gas is supplied to the surroundings of the airflow going from the first and second nozzle ports 122*a* and 124*a* into the container 2, and a gas having a low cleanliness in the intermediate chamber 60 can thereby effectively be prevented from entering the container 2.

The first and second nozzle ports 122*a* and 124*a* have any length in the Z-axis direction, but preferably have the same length in the Z-axis direction and preferably have a length in the Z-axis direction that is substantially equal to a height of the opening 2*b* of the container 2 in the Z-axis direction as shown in FIG. 7D. In this structure, cleaning gases blown from the first and second nozzle ports 122*a* and 124*a* can pass through front and rear surfaces of all of the wafers 1 housed in the container 2, and the container 2 can uniformly be cleaned.

Ninth Embodiment

Figure 11:
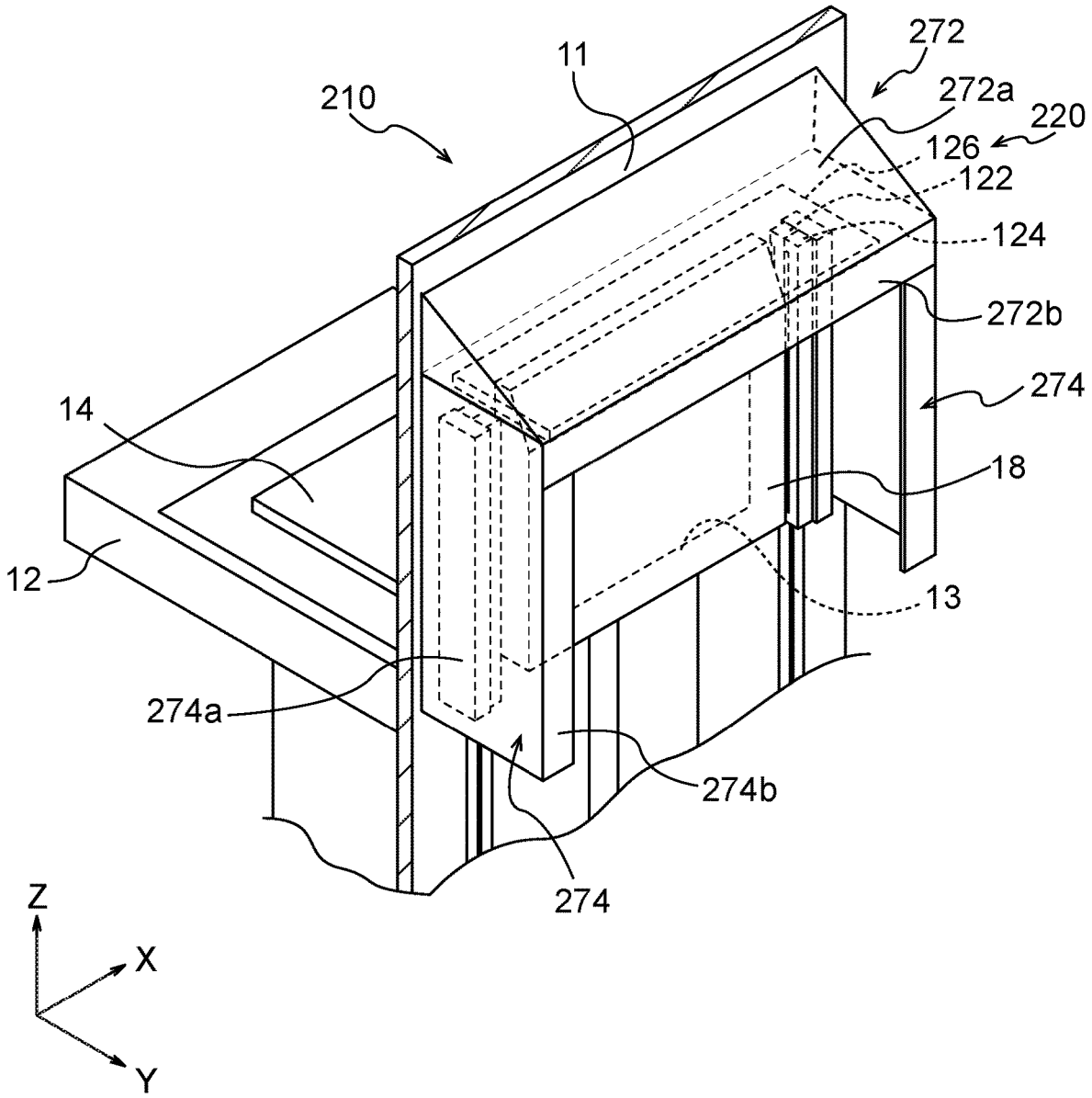
FIG. 11 is a schematic cross-sectional view of a part of a load port apparatus utilizing a gas purge unit according to Ninth Embodiment.

FIG. 11 is a schematic perspective view illustrating a load port apparatus 210 according to Ninth Embodiment of the present invention and corresponds to FIG. 6, which illustrates the load port apparatus 10 according to Eighth Embodiment. A gas purge unit 220 owned by the load port apparatus 210 according to Ninth Embodiment is different from the gas purge unit 120 owned by the load port apparatus 10 according to Eighth Embodiment in that the gas purge unit 220 includes an eave member 272 and a cover member 274, but the load port apparatus 210 is similar to the gas purge unit 120 in other matters. Thus, the gas purge unit 220 owned by the load port apparatus 210 is explained in terms of only differences from the gas purge unit 120.

The eave member 272 is disposed along the upper side 2*ba* (see FIG. 7D) of the opening 2*b* of the container 2 and protrudes outward from the inner surface of the wall 11 in the Y-axis direction (outward from the opening surface). The eave member 272 is disposed above the upper ends of the first and second blowout members 122 and 124 (above in the Z-axis). When the gas purge unit 220 includes the third blowout member 126, it is disposed under the eave member 272 (under in the Z-axis).

The eave member 272 has a triangular pillar outer shape extending in the Y-axis direction. An eave top surface 272*a* (a top surface of the eave member 272) is tilted downward in the Z-axis direction from the wall 11, but the eave member 272 may have any other shape, such as flat plate shape, another pillar shape, and curved surface shape. The eave member 272 has any length in the Y-axis direction, but preferably has a length in the Y-axis direction that covers two first blowout members 122 and two second blowout members 124 and is larger than a length of the third blowout member 126 in the Y-axis direction so as to cover the third blowout member 126.

Since the eave member 272 is disposed above the first to third blowout members 122, 124, and 126, an airflow having a comparatively low cleanliness formed in the intermediate chamber 60, such as a downflow by FFU, can be prevented from disturbing flows of cleaning gases from the first to third blowout members 122, 124, and 126. Incidentally, the eave member 272 includes an eave folding portion 272*b* bending downward from the tip of the eave top surface 272*a* along the X-axis direction and extending in parallel to the wall 11, and the downflow by FFU can more effectively be prevented from entering the surroundings of the opening 2*b*.

Figure 12:
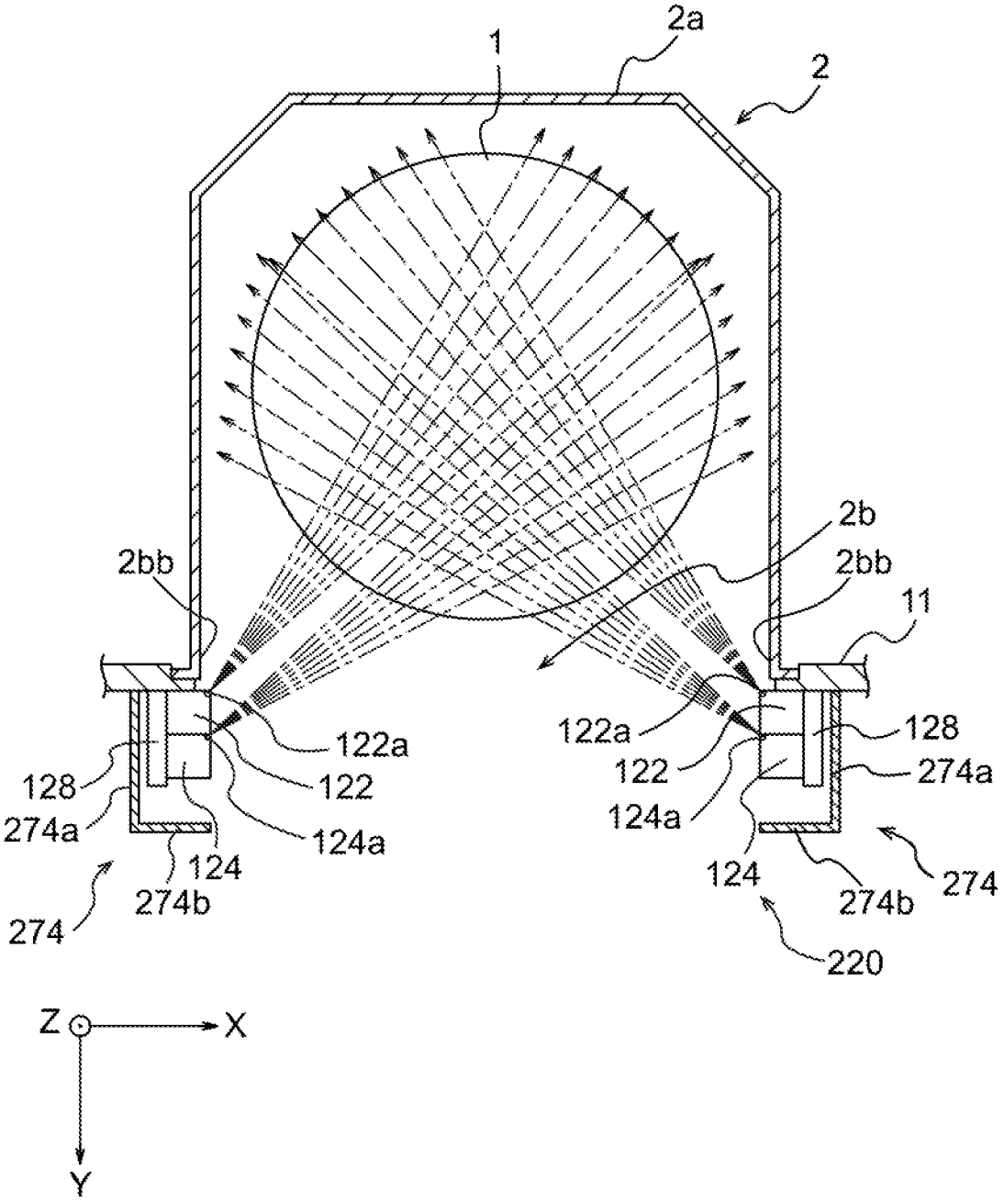
FIG. 12 is a schematic cross-sectional view of a horizontal cross section of a gas purge unit according to Tenth Embodiment.

As shown in FIG. 11 and FIG. 12, the cover members 274 are formed by a pair of L-shaped plate materials. The cover members 274 are arranged with a predetermined distance in the X-axis and Y-axis directions to the first and second blowout members 122 and 124 and cover the first and second blowout members 122 and 124 at least from the other side of blowout directions of the first and second nozzle ports 122*a* and 124*a*. The first and second blowout members 122 and 124 are arranged between the lateral sides 2*b* b of the opening 2*b* and the cover members 274.

As shown in FIG. 12, each of the cover members 274 includes a lateral-surface cover part 274*a* extending perpendicularly to the inner surface of the wall 11 and the opening surface and a folded cover part 274*b* folded from the tip of the lateral-surface cover part 274*a* to the opening 2*b* in the X-axis direction. Each of the folded cover parts 274*b* extends in parallel to the wall 11 and is disposed so as not to disturb movement paths of the door 18 and the lid 4 and movement paths of the robot arm 50 and the wafers 1.

Since the cover member 274 surrounds the first and second nozzle ports 122*a* and 124*a*, an airflow having a comparatively low cleanliness formed in the intermediate chamber 60, such as a downflow by FFU, can be prevented from disturbing flows of cleaning gases from the first to third blowout members 122, 124, and 126.

As shown in FIG. 11, the eave member 272 and the cover member 274 of the gas purge unit 220 are integrally connected to each other. The gas purge unit 220 can effectively prevent an airflow having a comparatively low cleanliness formed in the intermediate chamber 60 from disturbing flows of cleaning gases from the first to third blowout members 122, 124, and 126 and can simplify a protection structure of the flows of the cleaning gases.

Tenth Embodiment

Figure 13:
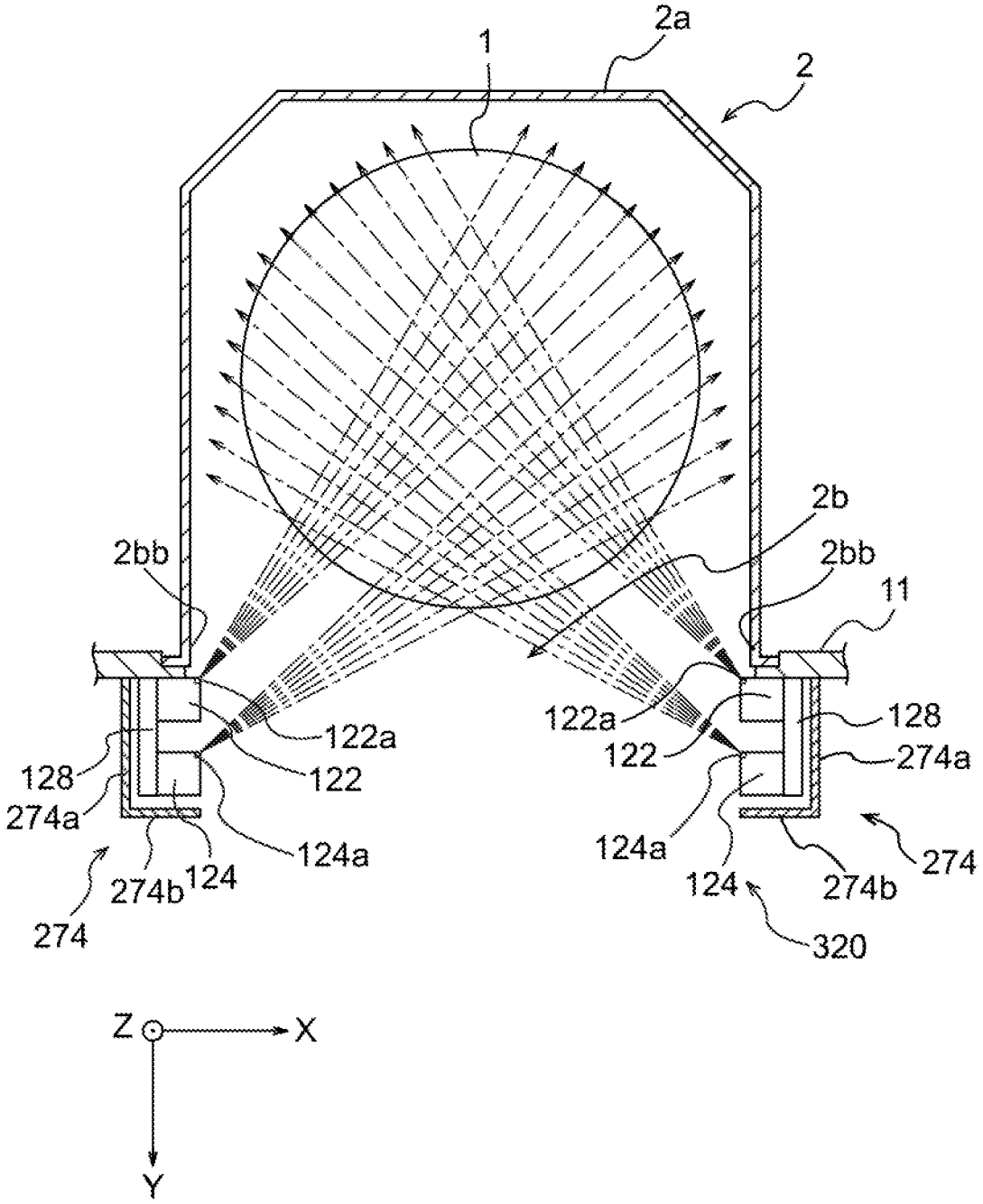
FIG. 13 is a schematic cross-sectional view of a horizontal cross section of a gas purge unit according to Eleventh Embodiment.

FIG. 13 is a schematic cross-sectional view of a gas purge unit 320 owned by a load port apparatus according to Tenth Embodiment of the present invention and corresponds to FIG. 12, which illustrates 220 according to Ninth Embodiment. The gas purge unit 320 owned by the load port apparatus according to Tenth Embodiment is different from the gas purge unit 220 according to Ninth Embodiment in that the first blowout member 122 and the second blowout member 124 are not in contact with each other and are arranged with a predetermined distance therebetween, but is similar to the gas purge unit 220 in other matters. Thus, the gas purge unit 320 is explained in terms of only differences from the gas purge unit 220.

In the gas purge unit 320, the first blowout member 122 and the second blowout member 124 are arranged with a distance in the Y-axis direction, and a distance between the first nozzle port 122*a* and the second nozzle port 124*a* in the Y-axis direction is larger than that of the gas purge unit 220 shown in FIG. 12. Thus, the gas purge unit 320 can reduce an interference between an airflow of a cleaning gas blown from the first nozzle port 122*a* and an airflow of a cleaning gas blown from the second nozzle port 124*a* and can achieve an efficient cleaning of the container 2. Moreover, thick layers of cleaning gases flowing into the container 2 can be produced in the space surrounded by the cover member 274 or so, and the gas purge unit 320 can thereby achieve an efficient cleaning while a gas having a low cleanliness is prevented from being drugged.

Figure 14:
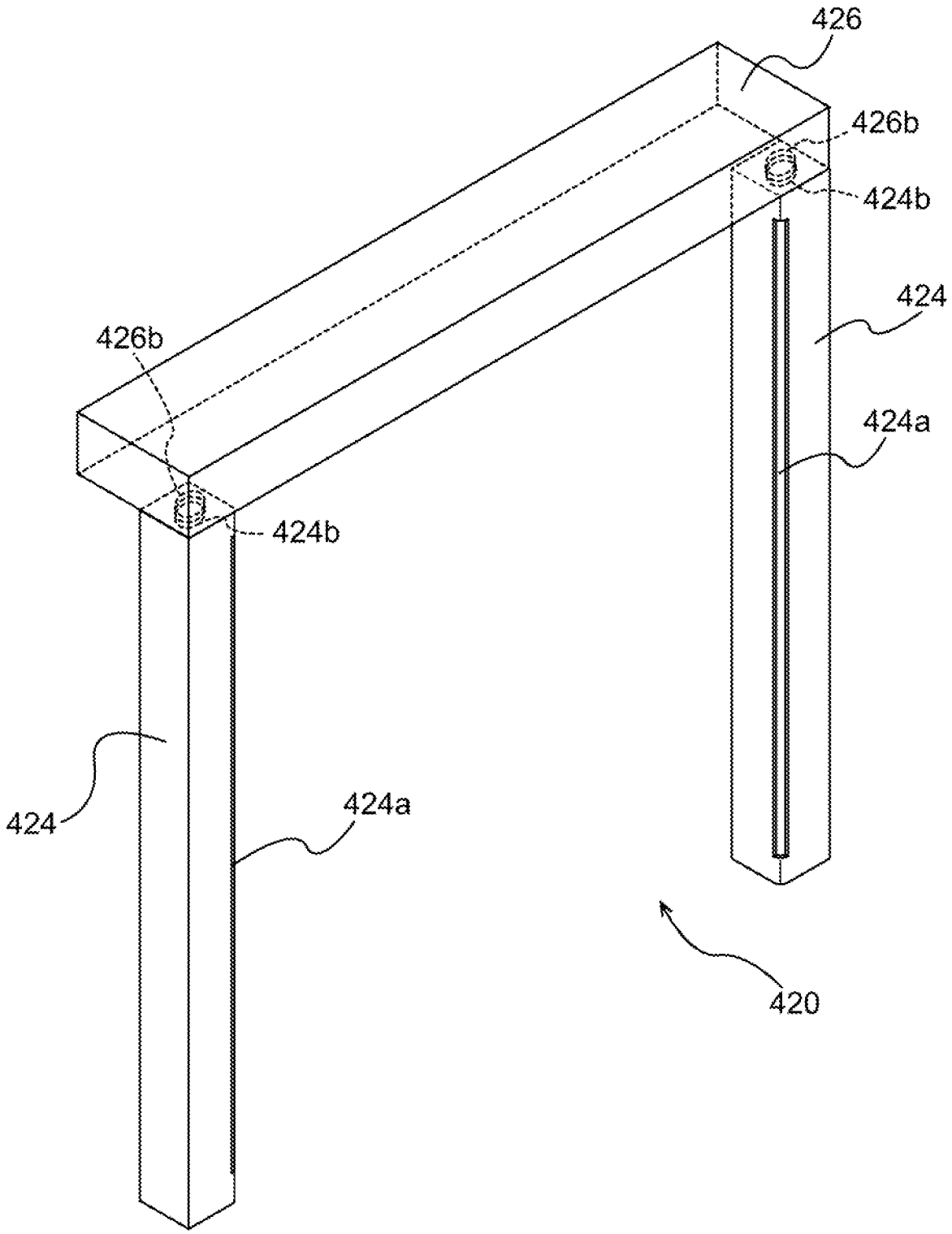
FIG. 14 is a schematic perspective view illustrating a gas purge unit according to a variation.

Hereinabove, the present invention is explained with the embodiments, but is not limited to the above-mentioned embodiments and may variously be changed within the scope of the present invention. For example, the second blowout member 124 and the third blowout member 126 according to each embodiment may be replaced with a second blowout member 424 and a third blowout member 426 of a gas purge unit 420 shown in FIG. 14. Incidentally, FIG. 14 does not illustrate a first blowout member of the gas purge unit 420 for easy explanation.

In the gas purge unit 420, a cleaning gas supplied from the second gas-supply section 134 shown in FIG. 9A to second channels 424*b* of the second blowout members 424 is also supplied to third channels 426*b* of the third blowout member 426 and is blown from the third nozzle port (see FIG. 7D). A cleaning gas may be supplied to either of the second channels 424*b* of the second blowout members 424 via the third channel 426*b* of the third blowout member 426 and may be blown from the second nozzle port 424*a*.

In the gas purge unit 420, the second channels 424*b* of the second blowout members 424 and the third channels 426*b* of the third blowout member 426 also function as a gas lateral pipe that supplies a cleaning gas to each blowout member. Thus, the gas purge unit 420 is simple in structure and is advantageous in downsizing. Instead of or in addition to the second blowout members 424, the third blowout member 426 and the first blowout members 122 (see FIG. 8 and FIG. 9A) may be connected to each other so that the third channel 426*b* and the first channels 122*b* are communicated. Also in this case, the channels of the blowout members function as a gas lateral pipe, and this gas purge unit is simple in structure and advantageous in downsizing.

In the gas purge units shown in Eighth to Tenth Embodiments, the blowout members disposed along the lateral side 2*b* b are formed by two types of blowout members (the first blowout member 122 including the first nozzle port 122*a* and the second blowout member 124 including the second nozzle port 124*a*), but this is not the only one gas purge unit of the present invention. The gas purge unit of the present invention may include another blowout member with a nozzle port whose distance from the opening 2*b* is different from that of the first nozzle port 122*a* and the second nozzle port 124*a*. This another blowout member may be disposed along the lateral side 2*b* b or the upper side 2*b* a and may be disposed diagonally.

The first blowout member 122 and the second blowout member 124 are not limited to those arranged in the X-axis direction as shown in FIG. 10 and may be arranged by being displaced in the X-axis direction. Moreover, the first and second nozzle ports 122*a* and 124*a* are formed by a slit-like through hole, but the nozzle ports of the present invention are not limited thereto. The nozzle ports of the present invention may be formed by intermittent multiple through holes and may be provided with a filter or so.

In the above-mentioned embodiments, the gas purge units of the present invention is applied to the load port apparatus 10, but may be applied to other apparatuses. For example, the gas purge unit of the present invention may be installed on devices and places requiring a clean environment.

NUMERICAL REFERENCES

1 . . . wafer
2 . . . sealed transport container
2*a* . . . casing
2*b* . . . opening
2*ba* . . . upper side
2*bb* . . . lateral side
2*c* . . . opening edge
3 . . . positioning portion
4 . . . lid
5 . . . intake port
6 . . . exhaust port
10 . . . load port apparatus
11 . . . wall
12 . . . installation stand
13 . . . wall-side opening
13*a* . . . lateral side
13*b* . . . upper side
13*c* . . . lower side
14 . . . movable table
16 . . . positioning pin
18 . . . door
20, 20*a* to 20*c*, 120, 120*a*, 220, 320, 420 . . . gas purge unit
21 . . . filter
22, 22*a* to 22*c* . . . bidirectional blowout member
22α . . . first-dedicated blowout member
22β . . . second-dedicated blowout member
23 . . . blowout channel
24 . . . intake member
25 . . . intake channel
26 . . . first nozzle port
27 . . . connecting hole
28 . . . second nozzle port
29 . . . connecting hole
30 . . . curtain nozzle
40 . . . FFU
50 . . . robot arm
60 . . . intermediate chamber
70 . . . processing chamber
122 . . . first blowout member
122*a* . . . first nozzle port
122*b* . . . first channel
124, 424 . . . second blowout member
124*a*, 424*a* . . . second nozzle port
124*b*, 424*b* . . . second channel
126, 426 . . . third blowout member
126*a*, 426*a* . . . third nozzle port
126*b*, 426*b* . . . third channel
128 . . . attachment member
132 . . . first gas-supply section
132*b* . . . first gas-supply pipe
132*a* . . . first gas-supply chamber
134 . . . second gas-supply section

134*b* . . . second gas-supply pipe
134*a* . . . second gas-supply chamber
138 . . . common gas-supply section
138*b* . . . branched gas-supply pipe
138*a* . . . common gas-supply chamber
272 . . . eave member
272*a* . . . eave top surface
272*b* . . . eave folding portion
274 . . . cover member
274*a* . . . lateral-surface cover part
274*b* . . . folded cover part

The invention claimed is:

1. A gas purge unit for introducing a cleaning gas into a purge container with an opening therethrough, comprising:

a first blowout member disposed along a lateral side of the opening and including a first nozzle port configured to blow the cleaning gas into the purge container; and a second blowout member disposed along the lateral side and including a second nozzle port arranged at a position farther from a center of the purge container than the first nozzle port and configured to blow the cleaning gas into the purge container, wherein a blowing angle of a center line of the cleaning gas blown out from the second nozzle port is smaller than a blowing angle of a center line of the cleaning gas blown out from the first nozzle port with respect to the a plane defining the opening.

2. The gas purge unit according to claim 1, further comprising a third blowout member disposed along an upper side of the opening and including a third nozzle port configured to blow the cleaning gas along of the opening.

3. The gas purge unit according to claim 2, wherein the first blowout member includes a first channel for the cleaning gas connected to the first nozzle port, the third blowout member includes a third channel for the cleaning gas connected to the third nozzle port, and the first blowout member and the third blowout member are connected so that the first channel and the third channel are in fluid communication with one another.

4. The gas purge unit according to claim 2, wherein the second blowout member includes a second channel for the cleaning gas connected to the second nozzle port, the third blowout member includes a third channel for the cleaning gas connected to the third nozzle port, and the second blowout member and the third blowout member are connected so that the second channel and the third channel are in fluid communication with one another.

5. The gas purge unit according to claim 1, further comprising a cover member disposed with a predetermined distance to the first blowout member and the second blowout member and surrounding the first blowout member and the second blowout member at least from an opposite side of a blowout direction of the first nozzle port and the second nozzle port.

6. The gas purge unit according to claim 1, further comprising an eave member disposed along an upper side of the opening and protruding in a normal direction out of the opening surface of the opening.

7. The gas purge unit according to claim 1, further comprising: a cover member disposed with a predetermined distance to the first blowout member and the second blowout member and surrounding the first blowout member and the second blowout member at least from an opposite of a blowout direction of the first nozzle port and the second nozzle port; and an eave member disposed along an upper side of the opening and protruding in a normal direction out of the opening, wherein the cover member and the eave member are integrally connected to each other.

8. A load port apparatus comprising the gas purge unit according to claim 1.

9. A gas purge unit for introducing a cleaning gas into a purge container with an opening therethrough, comprising:

a first nozzle port configured to blow the cleaning gas from at least one lateral side of the opening into the purge container; and a second nozzle port arranged at a position farther from a center of the purge container than the first nozzle port and configured to blow the cleaning gas into the purge container, wherein the first nozzle port and the second nozzle port blow out the cleaning gas into the purge container independently from one another, a blowing of angle of a center line of the cleaning gas blown out from the second nozzle port is smaller than a blowing of angle of a center line of the cleaning gas blown out from the first nozzle port with respect to a plane defining the opening.

10. The gas purge unit according to claim 9, wherein the first nozzle port and the second nozzle port are formed on a single bidirectional blowout member.

11. The gas purge unit according to claim 9, wherein the first nozzle port is formed on a first-dedicated blowout member disposed at the at least one lateral side of the opening.

12. The gas purge unit according to claim 9, wherein the second nozzle port is formed on a second-dedicated blowout member disposed at the at least one lateral side of the opening.

13. The gas purge unit according to claim 9, comprising: a pair of first-dedicated blowout members, wherein the first nozzle port is formed on each first-dedicated blowout member of the pair of blowout members, the second nozzle port is formed on a second-dedicated blowout member, each of the first-dedicated blowout members is located at opposing lateral sides of the opening arranged to face each other, and the second-dedicated blowout member is disposed at the at least one lateral side of the opening.

14. The gas purge unit according to claim 9, comprising: a pair of second-dedicated blowout members, wherein the first nozzle port is formed on a first-dedicated blowout member, the second nozzle port is formed on each second-dedicated blowout member of the pair of blowout members, each of the second-dedicated blowout members is located at opposing lateral sides of the opening arranged to face each other, and the first-dedicated blowout member is disposed at the at least one lateral sides of the opening.

15. A load port apparatus comprising the gas purge unit according to claim 9.

* * * * *